US010780314B2

(12) United States Patent
Giannelli et al.

(10) Patent No.: US 10,780,314 B2
(45) Date of Patent: Sep. 22, 2020

(54) EXERCISE APPARATUS

(71) Applicant: Cybex International, Inc., Lake Forest, IL (US)

(72) Inventors: Raymond Giannelli, Franklin, MA (US); Mark Buontempo, Millville, MA (US)

(73) Assignee: Cybex International, Inc., Medway, MA (US)

( * ) Notice: Subject to any disclaimer, the term of this patent is extended or adjusted under 35 U.S.C. 154(b) by 67 days.

(21) Appl. No.: 16/050,538

(22) Filed: Jul. 31, 2018

(65) Prior Publication Data

US 2018/0333605 A1 Nov. 22, 2018

Related U.S. Application Data

(63) Continuation of application No. 15/466,978, filed on Mar. 23, 2017, now abandoned, which is a
(Continued)

(51) Int. Cl.
*A63B 22/00* (2006.01)
*A63B 71/06* (2006.01)
(Continued)

(52) U.S. Cl.
CPC .... *A63B 22/0015* (2013.01); *A63B 21/00069* (2013.01); *A63B 21/225* (2013.01);
(Continued)

(58) Field of Classification Search
CPC ..... A63B 21/00058; A63B 21/00069; A63B 21/00072; A63B 21/005; A63B 21/0051;
(Continued)

(56) References Cited

U.S. PATENT DOCUMENTS 267,042 A 11/1882 Van Nette
287,891 A 11/1883 Unangst
(Continued)

FOREIGN PATENT DOCUMENTS

CN 1984697 6/2007
JP 3183390 5/2013
(Continued)

OTHER PUBLICATIONS

International Search Report and Written Opinion for Corresponding International Patent Application No. PCT/US2017/023375; dated May 22, 2017.
(Continued)

*Primary Examiner* — Gary D Urbiel Goldner
(74) *Attorney, Agent, or Firm* — Andrus Intellectual Property Law, LLP

(57) ABSTRACT

An exercise device having a frame, first and second foot supports suspended on the frame by first and second linkage assemblies, one or the other or both of the frame linkage assemblies being interconnected to an adjustment device that is selectively adjustable by a user to select one of a plurality of discrete segments of a master or overall path of arcuate travel and to a lateral adjustment device that enables the user to selectively adjust a path of travel of the foot supports a selected angle relative to a central axis of the exercise device.

16 Claims, 14 Drawing Sheets

Related U.S. Application Data continuation of application No. PCT/US2017/023375, filed on Mar. 21, 2017, application No. 16/050,538, which is a continuation of application No. PCT/US2017/023375, filed on Mar. 21, 2017.

(60) Provisional application No. 62/313,256, filed on Mar. 25, 2016.

(51) Int. Cl.

| | |
|---|---|
| ***A63B 21/22*** | (2006.01) |
| ***A63B 21/00*** | (2006.01) |
| ***A63B 22/06*** | (2006.01) |
| ***A63B 23/035*** | (2006.01) |
| ***A63B 22/20*** | (2006.01) |

(52) U.S. Cl.

CPC ..... *A63B 21/4034* (2015.10); *A63B 21/4035* (2015.10); *A63B 22/001* (2013.01); *A63B 22/0046* (2013.01); *A63B 22/0056* (2013.01); *A63B 22/0061* (2013.01); *A63B 22/0664* (2013.01); *A63B 23/03591* (2013.01); *A63B 71/0619* (2013.01); *A63B 2022/0028* (2013.01); *A63B 2022/0051* (2013.01); *A63B 2022/0053* (2013.01); *A63B 2022/0676* (2013.01); *A63B 2022/206* (2013.01)

(58) Field of Classification Search

CPC . A63B 21/0052; A63B 21/0056; A63B 21/15; A63B 21/159; A63B 21/22; A63B 21/225; A63B 21/4027; A63B 21/4033; A63B 21/4034; A63B 21/4035; A63B 21/4045; A63B 21/4047; A63B 21/4049; A63B 22/0002; A63B 22/0007; A63B 22/001; A63B 22/0015; A63B 22/0017; A63B 22/025; A63B 22/0046; A63B 22/0048; A63B 22/0056; A63B 22/0061; A63B 22/06; A63B 22/0664; A63B 22/20; A63B 22/201; A63B 2022/002; A63B 2022/0028; A63B 2022/0043; A63B 2022/0051; A63B 2022/0053; A63B 2022/0676; A63B 2022/0682; A63B 2022/206; A63B 23/035; A63B 23/03516; A63B 23/03533; A63B 23/03575; A63B 23/03591; A63B 23/04; A63B 23/0405; A63B 23/0423; A63B 23/0429; A63B 23/0482; A63B 23/0488; A63B 23/0494; A63B 23/12; A63B 23/1209; A63B 23/1245; A63B 23/1263; A63B 23/1281; A63B 2023/0441; A63B 2023/0452; A63B 1/0054; A63B 1/0072; A63B 2208/0204; A63B 2225/09; A63B 2225/093

See application file for complete search history.

(56) References Cited

U.S. PATENT DOCUMENTS

| | | | |
|---|---|---|---|
| 587,891 | A | 8/1897 | Walker |
| 4,344,616 | A | 8/1982 | Ogden |
| 4,776,582 | A | 10/1988 | Ramhorst |
| 4,781,372 | A | 11/1988 | McCormack |
| 4,842,266 | A | 6/1989 | Sweeney, Sr. |
| 4,915,373 | A | 4/1990 | Walker |
| 5,114,388 | A | 5/1992 | Trulaske |
| 5,254,066 | A | 10/1993 | Brown et al. |
| 5,626,535 | A | 5/1997 | Kono et al. |
| 5,626,538 | A | 5/1997 | Dalebout et al. |
| 6,231,484 | B1 | 5/2001 | Gordon |
| 6,234,935 | B1 | 5/2001 | Chu |
| 7,278,955 | B2 | 10/2007 | Giannelli et al. |
| 7,402,126 | B2 | 7/2008 | Chang |
| 7,425,189 | B1 | 9/2008 | Eschenbach |
| 7,547,267 | B1 | 6/2009 | Wang |
| 7,568,999 | B2 | 8/2009 | Giannelli et al. |
| 7,608,019 | B1 | 10/2009 | Stearns et al. |
| 7,682,293 | B2 | 3/2010 | Eschenbach |
| 7,686,743 | B2 | 3/2010 | Eschenbach |
| 7,824,313 | B2 | 11/2010 | Giannelli et al. |
| 8,025,609 | B2 | 9/2011 | Giannelli et al. |
| 8,057,363 | B2 | 11/2011 | Giannelli et al. |
| 8,062,185 | B2 | 11/2011 | Giannelli et al. |
| 8,128,535 | B2 | 3/2012 | Giannelli et al. |
| 8,162,805 | B2 | 4/2012 | Giannelli et al. |
| 8,454,478 | B2 | 6/2013 | Giannelli et al. |
| 8,852,059 | B1 | 10/2014 | Stearns et al. |
| 9,061,175 | B1 | 6/2015 | Miller et al. |
| 9,132,314 | B1 | 9/2015 | Giannelli et al. |
| 9,144,705 | B1 | 9/2015 | Giannelli et al. |
| 9,192,809 | B1 | 11/2015 | Miller et al. |
| 9,457,224 | B2 | 10/2016 | Giannelli et al. |
| 9,457,230 | B2 | 10/2016 | Giannelli et al. |
| 9,498,672 | B1 | 11/2016 | Miller |
| 9,511,253 | B1 | 12/2016 | Miller |
| 9,586,085 | B2 | 3/2017 | Arnold et al. |
| 9,700,755 | B2 | 7/2017 | Giannelli et al. |
| 9,757,614 | B1 | 9/2017 | Giannelli et al. |
| 9,873,014 | B1 | 1/2018 | Kuo |
| 9,901,774 | B2 | 2/2018 | Miller et al. |
| 9,937,380 | B2 | 4/2018 | Giannelli et al. |
| 10,105,569 | B2 | 10/2018 | Giannelli et al. |
| 2002/0091042 | A1 | 7/2002 | Kuo |
| 2003/0092532 | A1 | 5/2003 | Giannelli et al. |
| 2004/0097335 | A1 | 5/2004 | Chu |
| 2004/0224825 | A1 | 11/2004 | Giannelli et al. |
| 2004/0241631 | A1 | 12/2004 | Nizamuddin |
| 2005/0079956 | A1 | 4/2005 | Bruno |
| 2006/0035754 | A1 | 2/2006 | Giannelli et al. |
| 2006/0040794 | A1 | 2/2006 | Giannelli et al. |
| 2006/0046902 | A1 | 3/2006 | Chang |
| 2006/0172864 | A1 | 8/2006 | Wang |
| 2007/0021274 | A1 | 1/2007 | Moon |
| 2007/0123393 | A1 | 5/2007 | Giannelli et al. |
| 2007/0129217 | A1 | 6/2007 | Giannelli et al. |
| 2007/0202999 | A1 | 8/2007 | Giannelli et al. |
| 2008/0032869 | A1 | 2/2008 | Pacheco et al. |
| 2008/0261780 | A1 | 10/2008 | Giannelli et al. |
| 2008/0287265 | A1 | 11/2008 | Giannelli et al. |
| 2009/0042699 | A1 | 2/2009 | Giannelli et al. |
| 2009/0258762 | A1 | 10/2009 | Stearns et al. |
| 2010/0093497 | A1 | 4/2010 | Kuo |
| 2010/0151999 | A1 | 6/2010 | Kuo |
| 2010/0152000 | A1 | 6/2010 | Giannelli et al. |
| 2010/0267524 | A1 | 10/2010 | Stewart et al. |
| 2011/0143885 | A1 | 6/2011 | Giannelli et al. |
| 2012/0004077 | A1 | 1/2012 | Chu |
| 2012/0149532 | A1 | 6/2012 | Giannelli et al. |
| 2012/0322621 | A1 | 12/2012 | Bingham, Jr. et al. |
| 2013/0210578 | A1 | 8/2013 | Birrell |
| 2013/0310220 | A1 | 11/2013 | Pacheco et al. |
| 2014/0194253 | A1 | 7/2014 | Huang |
| 2014/0194254 | A1 | 7/2014 | Huang et al. |
| 2014/0221166 | A1 | 8/2014 | Huang et al. |
| 2014/0274573 | A1 | 9/2014 | Chang et al. |
| 2014/0336006 | A1 | 11/2014 | Miller |
| 2014/0336007 | A1 | 11/2014 | Miller |
| 2015/0246260 | A1 | 9/2015 | Giannelli et al. |
| 2015/0335943 | A1 | 11/2015 | Miller |
| 2015/0335944 | A1 | 11/2015 | Miller |
| 2015/0352402 | A1 | 12/2015 | Arnold et al. |
| 2016/0059067 | A1 | 3/2016 | Miller |
| 2016/0129301 | A1 | 5/2016 | Giannelli et al. |
| 2016/0151659 | A1 | 6/2016 | Arnold et al. |
| 2016/0151663 | A1 | 6/2016 | Miller |
| 2016/0151665 | A1 | 6/2016 | Miller |
| 2016/0184640 | A1 | 6/2016 | Giannelli et al. |
| 2016/0263427 | A1 | 9/2016 | Mueller et al. |
| 2016/0375300 | A1 | 12/2016 | Chang et al. |

(56) References Cited

U.S. PATENT DOCUMENTS

| | | | | |
|---|---|---|---|---|
| 2016/0375301 | A1 | 12/2016 | Giannelli et al. | |
| 2017/0056709 | A1 | 3/2017 | Ercanbrack et al. | |
| 2017/0056717 | A1 | 3/2017 | Ercanbrack et al. | |
| 2017/0106231 | A1 | 4/2017 | Liao et al. | |
| 2017/0173381 | A1 | 6/2017 | Giannelli et al. | |
| 2018/0036587 | A1 | 2/2018 | Giannelli et al. | |
| 2018/0193692 | A1 | 7/2018 | Giannelli et al. | |
| 2018/0272181 | A1* | 9/2018 | Giannelli ..... | A63B 22/0015 |
| 2018/0333605 | A1 | 11/2018 | Giannelli et al. | |

FOREIGN PATENT DOCUMENTS

| | | | |
|---|---|---|---|
| KR | 100834880 | | 6/2008 |
| WO | 2015/038732 | A1 | 3/2015 |

OTHER PUBLICATIONS

International Preliminary Report on Patentability, PCT/US2017/023375, dated Oct. 4, 2018.
International Search Report and Written Opinion for PCT/US2014/064965 dated Sep. 1, 2015.
International Search Report and Written Opinion for PCT/US2014/055124 dated Feb. 4, 2015.
International Preliminary Report on Patentability for PCT/US2014/055124 dated Dec. 15, 2015.

* cited by examiner

EXERCISE APPARATUS

RELATED APPLICATIONS

This application is a continuation of and claims the benefit of priority to U.S. application Ser. No. 15/466,978 filed Mar. 23, 2017 which claims the benefit of priority to PCT/US2017/023375 filed Mar. 21, 2017, which claims the benefit of priority to U.S. Provisional Application No. 62/313,256 filed Mar. 25, 2016, the disclosures of all of which are incorporated by reference as if fully set forth herein. This application is also a continuation of and claims the benefit of priority to PCT/US2017/023375 filed Mar. 21, 2017, which claims the benefit of priority to U.S. Provisional Application No. 62/313,256 filed Mar. 25, 2016, the disclosures of all of which are incorporated by reference as if fully set forth herein.

FIELD OF THE INVENTION

The present invention relates to physical exercise machines and more particularly to an exercise apparatus that enables users to perform a simulated walking, running or other back and forth leg movement exercise having a lateral component.

BACKGROUND OF THE INVENTION

Exercise machines for simulating walking or running are known and used for directing the movement of a user's legs and feet in a variety of repetitive paths of travel. Machines commonly referred to as elliptical path machines have been designed to pivot the foot pedals on which the user's feet reside causing the pedals and the user's feet to travel in an elliptical or arcuate path. The angular degree of pivoting of the foot pedals in such elliptical or arcuate machines changes as the foot pedal travels from back to front and front to back along the path of travel or translation of the user's foot, by typically more than about 3 degrees and more typically more than 10-30 degrees. The path of travel of the foot pedal in such machines is not adjustable other than to change the shape of the ellipse. The foot travels along a different path from back to front than from front to back in such elliptical machines. There is no provision in such prior apparati for incorporating upper body exercise. There is no provision of a handle or hand grip that is interconnected to a foot pedal which together move/pivot simultaneously in the same back or forth direction. Further, there is no provision for the incorporation of guided lateral movement along the path of travel.

SUMMARY OF THE INVENTION

In accordance with the invention there is provided In accordance with the invention there is provided An exercise device comprising:

a frame (10) having a generally vertical planar axis (PA), first and second foot supports (24*a*, 24*b*) suspended on the frame (10) by first (18*c*, 26*c*, 26*b*) and second (18*d*, 26*a*, 26*d*) linkage assemblies that are respectively arranged on the frame (10) such that the first and second foot supports (24*a*, 24*b*) are pivotable through a front to back arcuate path of travel (PT1, PT2) that is disposed at a selected angle (θ, θ') between about five and about forty five degrees relative to the generally vertical planar axis (PA), one or the other or both of the frame linkage assemblies being interconnected to an adjustment device (55, 56) that is selectively adjustable by a user to select one of a plurality of discrete segments (AP, P1, AP', P2) of a master or overall path of arcuate travel (J) for the foot supports, wherein each one of the plurality of discrete segments (AP, AP', P1, P2) are delimited by a unique forwardmost (FM1, FM2) and a unique rearwardmost (RM1, RM2) position contained within the master or overall path (J) of arcuate travel.

The frame (10) and linkage assemblies are preferably arranged such that a front edge (60) of a longitudinal axis (B) of the foot supports (24*a*, 24*b*) when disposed in the rearwardmost (RM1, RM2) position is spaced a rear lateral distance (RLD) from the generally vertical planar axis (PA) that extends from four inches to three feet measured along a line between the front edge (60) and the generally vertical planar axis (PA) that is normal to or intersects the generally vertical planar axis (PA) at ninety degrees and, the front edge (60) of the longitudinal axis (B) of the foot supports (24*a*, 24*b*) when disposed in the forwardmost (FM1, FM2) position is spaced a forward lateral distance (FLD) from the generally vertical planar axis (PA) that is at least three inches less than the rear lateral distance (RLD), typically 3 inches to 3 feet less, and preferably 8 inches to 3 feet less, measured along a line between the front edge (60) and the generally vertical planar axis (PA) that is normal to or intersects the generally vertical planar axis (PA) at ninety degrees.

Each of the plurality of discrete segments (AP, AP', P1, P2) typically defines a complete, reproducible path of exercise travel or cycle where the foot supports travel either from the unique rearwardmost (RM1, RM2) position to the unique forwardmost (FM1, FM2) position and back to the unique rearwardmost (RM1, RM2) position or from the unique forwardmost (FM1, FM2) position to the unique rearwardmost (RM1, RM2) and back to the unique forwardmost (FM1, FM2) position.

Such an apparatus can further comprise a lateral adjustment device (58*a*, 58*b*) interconnected to the linkage assemblies that enables the user to selectively adjust the selected angle (θ, θ') a selected degree.

The foot supports (24*a*, 24*b*) or the linkage assemblies (18*c*, 26*c*, 26*b*, 18*d*, 26*a*, 26*d*) typically travel along a path within a generally vertical travel plane (LP1, LP2) that is disposed at the selected angle (θ, θ') relative to the generally vertical planar axis (PA).

The overall or master arcuate path (J) is preferably a circular path defined around a single point (C).

The resistance assembly (55) can comprise a flywheel or pulley (34) or crank (40*a*, 40*b*).

The apparatus can further comprise first and second manually graspable input arms (100*a*, 100*b*) each pivotably interconnected to a respective one of the first and second foot supports (24*a*, 24*b*).

The arms (100*a*, 100*b*) are preferably interconnected to the foot supports in an arrangement wherein the first input arm (100*a*) pivots forwardly together with forward and upward movement of the first foot support (24*a*), the first input arm (100*a*) pivots rearwardly together backward and downward movement of the first foot support (23*a*), the second input arm (100*b*) pivots forwardly together with forward and upward movement of the second foot support (24*b*) and the second input arm (100*b*) pivots rearwardly together with backward and downward movement of the second foot support (24*b*).

The resistance assembly typically comprises a resistance device that increases resistance exponentially relative to degree of increase in speed or velocity of movement of one or more of the foot pedals (24*a*), the arms (100*a*, 100*b*) or a moving component of the resistance assembly (55).

The exercise device can further include a segment adjustment device interconnected to the resistance assembly in an arrangement that defines said arc segments such that each arc segment has a different degree of incline.

The frame linkage assembly typically has a first end and a second end, wherein the first end of the frame linkage assembly is pivotally engaged with the frame, and wherein the second end of the frame linkage assembly is pivotally engaged with the foot support.

The frame linkage assembly preferably comprises a four bar linkage.

The exercise device can further comprise a motor interconnected to the crank, the motor being operable to controllably move the location of the crank to controllably select an arc segment.

The foot support typically comprises or is mounted on a linkage (62) that comprises a linkage of the four bar linkage.

The adjustment device can be manually actuatable by the user to enable the user to manually move the adjustment to any selectable one of a plurality of different fixed mechanical positions that fix or limit travel of the foot support via interconnection to the arc segment selection device to a corresponding one of the plurality of different arc segments (AP, AP'), the user selecting one of the plurality of different arc segments (AP, AP') by exerting a selected amount or degree of manual force on the adjustment device that corresponds to a selected one of the plurality of different fixed mechanical positions.

The first and second foot supports (24*a*, 24*b*) are preferably pivotable through a front to back arcuate path of travel (PT1, PT2) that is disposed at a selected angle (θ, θ') between about ten and about twenty five degrees relative to the generally vertical planar axis (PA).

In another aspect of the invention there is provided a method of performing an exercise comprising disposing a left and right foot of a user in the first and second foot supports of the exercise device according to any of the foregoing described devices and moving the user's feet back and forth while disposed in the first and second foot supports.

In another aspect of the invention there is provided an exercise device comprising:

a frame (10) having a generally vertical planar axis (PA), first and second foot supports (24*a*, 24*b*) suspended on the frame (10) and pivotally mounted on a distal end of first (18*c*, 26*c*, 26*b*, 62) and second (18*d*, 26*a*, 26*d*, 62) linkage assemblies pivotally mounted on the frame (10), the frame (10) and the linkage assemblies being adapted such that the first and second foot supports (24*a*, 24*b*) are pivotable through a front to back arcuate path of travel (PT1, PT2), one or the other or both of the frame linkage assemblies being interconnected to an adjustment device (55) that is selectively adjustable by a user to select one of a plurality of discrete segments (AP, P1, AP', P2) of a master or overall path of arcuate travel (J) for the foot supports, wherein each one of the plurality of discrete segments (AP, AP', P1, P2) are delimited by a unique forwardmost (FM1, FM2) and a unique rearwardmost (RM1, RM2) position contained within the master or overall path (J) of arcuate travel, wherein the frame (10) and linkage assemblies are arranged such that a front edge (60) of a longitudinal axis (B) of the foot supports (24*a*, 24*b*) when disposed in the rearwardmost (RM1, RM2) position is spaced a rear lateral distance (RLD) from the generally vertical planar axis (PA) that extends from four inches to three feet measured along a line between the front edge (60) and the generally vertical planar axis (PA) that is normal to or intersects the generally vertical planar axis (PA) at ninety degrees and, the front edge (60) of the longitudinal axis (B) of the foot supports (24*a*, 24*b*) when disposed in the forwardmost (FM1, FM2) position is spaced a forward lateral distance (FLD) from the generally vertical planar axis (PA) that is at least three inches less than the rear lateral distance (RLD), typically 3 inches to 3 feet less, and preferably 8 inches to 3 feet less, measured along a line between the front edge (60) and the generally vertical planar axis (PA) that is normal to or intersects the generally vertical planar axis (PA) at ninety degrees.

In such a device the first and second foot supports and the linkage assemblies are preferably arranged on the frame (10) such that the first and second foot supports (24*a*, 24*b*) are pivotable through a front to back arcuate path of travel (PT1, PT2) that is disposed at a selected angle (θ, θ') between about five and about forty five degrees relative to the generally vertical planar axis (PA).

Such a device can further comprise first and second manually graspable input arms (100*a*, 100*b*) each pivotably interconnected to a respective one of the first and second foot supports (24*a*, 24*b*).

The arms (100*a*, 100*b*) are typically interconnected to the foot supports in an arrangement wherein the first input arm (100*a*) pivots forwardly together with forward and upward movement of the first foot support (24*a*), the first input arm (100*a*) pivots rearwardly together backward and downward movement of the first foot support (23*a*), the second input arm (100*b*) pivots forwardly together with forward and upward movement of the second foot support (24*b*) and the second input arm (100*b*) pivots rearwardly together with backward and downward movement of the second foot support (24*b*).

The resistance assembly preferably comprises a device that increases resistance exponentially relative to degree of increase in speed or velocity of movement of one or more of the foot pedals (24*a*), the arms (100*a*, 100*b*) or a moving component of the resistance assembly (55).

The device can include a segment adjustment device interconnected to the resistance assembly in an arrangement that defines said arc segments such that each arc segment has a different degree of incline.

The frame linkage assembly typically comprises a four bar linkage.

The device can further comprise a motor interconnected to the crank, the motor being operable to controllably move the location of the crank to controllably select an arc segment.

The foot support typically comprises or is mounted on a linkage that comprises a linkage of the four bar linkage.

The adjustment device can be manually actuatable by the user to enable the user to manually move the adjustment to any selectable one of a plurality of different fixed mechanical positions that fix or limit travel of the foot support via interconnection to the arc segment selection device to a corresponding one of the plurality of different arc segments (AP, AP'), the user selecting one of the plurality of different arc segments (AP, AP') by exerting a selected amount or degree of manual force on the adjustment device that corresponds to a selected one of the plurality of different fixed mechanical positions.

Each of the plurality of discrete segments (AP, AP', P1, P2) typically defines a complete, reproducible path of exercise travel or cycle where the foot supports travel either from the unique rearwardmost (RM1, RM2) position to the unique forwardmost (FM1, FM2) position and back to the unique rearwardmost (RM1, RM2) position or from the unique forwardmost (FM1, FM2) position to the unique rearwardmost (RM1, RM2) and back to the unique forwardmost (FM1, FM2) position.

In another aspect of the invention there is provided a method of performing an exercise comprising disposing a left and right foot of a user in the first and second foot supports of the exercise device and moving the user's feet back and forth while disposed in the first and second foot supports.

In another aspect of the invention there is provided an exercise apparatus comprising:

a foot support arranged on a frame for supporting a user standing on the foot support, the foot support being movable along an arcuate path offset laterally at an angle relative to a longitudinal axis (A) of the frame, and a linkage assembly coupling the foot support to a resistance assembly, the linkage assembly being adjustable to select one of a plurality of segments of the arcuate path for back and forth movement by the foot support, the selected segment being delimited by a forward position of the foot support and a rearward position of the foot support, the linkage assembly and resistance assembly cooperating to allow the foot support to move back and forth through said selected segment for each successive back and forth movement of the foot support by a user.

A horizontal orientation of the foot support can be adjustable relative to the longitudinal axis (A) of the frame. A longitudinal axis (B) of the foot support can remain parallel with the longitudinal axis (A) of the frame for each successive back and forth movement of the foot support by the user.

The angle of the arcuate path is preferably laterally adjustable relative to the longitudinal axis (A) of the frame, and the longitudinal axis (B) of the foot support remains parallel with the longitudinal axis (A) of the frame during adjustment of the angle.

The linkage assembly can include a frame linkage movably engaged with the frame, wherein the foot support is movably engaged with the frame linkage.

The frame linkage can have a first end and a second end, where the first end of the frame linkage is pivotally engaged with the frame, and wherein the second end of the frame linkage is pivotally engaged with the foot support. The frame linkage can also include opposing pairs of linkages including a front frame linkage and a rear frame linkage, the front frame linkage pivotally coupled to a front area of the foot support and the rear frame linkage pivotally coupled to a rear area of the foot support.

The foot support can be supported by the frame linkage in a cantilevered arrangement.

The frame linkage can include a four bar linkage mechanism. In some cases, the four bar linkage mechanism includes a bottom linkage and a front frame linkage that are pivotally interconnected to a rear frame linkage for back and forth movement, the foot support being mounted on or to the bottom linkage in the cantilevered arrangement rearward of the rear frame linkage.

The linkage assembly further includes a drive linkage, wherein the drive linkage is connected at its first end to the frame linkage and at its opposing end to the resistance assembly.

The resistance assembly preferably includes at least one of a friction mechanism, an air resistance mechanism, and a electromechanical braking device. The resistance assembly can include a flywheel and a crank arm coupled to the flywheel, and wherein the drive linkage is connected at its first end to the frame linkage and at its opposing end to the crank arm.

The exercise apparatus can further comprise a manually graspable input arm pivotably interconnected to the foot support such that the arm pivots forwardly together with forward and upward movement of the foot support and rearwardly together with backward and downward movement of the foot support. The input arm can be adjustable to move in a pivot path of selected degree of pivot.

The foot support can be supported on a curved surface of a ramp extending along the arcuate path.

Further provided is an exercise device comprising:

A foot support suspended from above on a frame having a front to back generally vertically planar longitudinal axis (B), the foot support being suspended on the frame by a pivotable linkage that supports a user in a generally upright position with the user's foot disposed on the foot support wherein the generally vertically planar axis (PA) generally intersects a median of an upper torso of the user when the user is disposed in the generally upright position, The pivotable linkage being arranged on the frame to guide the foot support along a master arcuate path of travel that is oriented at a selected lateral angle relative to the generally vertically planar axis (PA) wherein the master arcuate path of travel extends between a forwardmost upward lateral position and a reawardmost downward lateral position, An adjustment device interconnected to the pivotable linkage or the foot support, the adjustment device being controllably actuatable to limit travel of the foot support to a selectable one of a plurality of complete, reproducible different segments of the master arcuate path of travel, each segment comprising a different portion of the master arcuate path of travel, each different segment being defined such that the foot support travels between a segment specific forwardmost upward lateral position and a segment specific rearwardmost downward lateral position.

The foot support can be pivotably mounted to the linkage for rotation in a plane generally perpendicular to the generally vertically planar axis (PA).

The linkage can form one of the linkages of a four bar linkage, the four bar linkage further comprising a bottom linkage and a front linkage that are pivotally interconnected to the linkage that supports the user in a generally upright position.

The foot support can be pivotably mounted to the linkage in a cantilevered arrangement.

The adjustment device can adjustably interconnected to the cantilevered linkage through one or more other linkages, the adjustment device being operable by the user to select any one out of the plurality of different segments, each separate one of the plurality of different segments being reproducible and having a separate degree of incline and a separate rearwardmost and forwardmost position determined by the incline selector.

The linkage can form one of the linkages of a four bar linkage, the four bar linkage further comprising a rear linkage and a front linkage that are pivotally interconnected to the linkage for back and forth movement, the foot support being pivotably mounted on or to the linkage in the cantilevered arrangement rearward of the rear linkage.

The front linkage of the four bar linkage can be connected to an arm that reciprocally rotates together with the back and forth movement of the front linkage, the arm being interconnected to a resistance mechanism.

The resistance mechanism can be a wheel mechanism.

The arm can be pivotally interconnected to a link that is pivotally interconnected to the resistance mechanism.

The exercise device can further comprise a manually graspable input arm pivotably interconnected to the foot support such that the arm pivots forwardly together with forward and upward movement of the foot support and rearwardly together with backward and downward movement of the foot support.

The foot support can be supported on the linkage, the linkage being supported on a curved surface of a ramp having a selected curved path of travel, the linkage being drivable by the user back and forth along the curved surface of the ramp between a rearwardmost position and a forwardmost position and the foot support travelling in a path together with the linkage along the selected curved path of travel of the ramp from the rearwardmost to the forwardmost positions and back along the same path to the rearwardmost position from the forwardmost position of each selected arc segment.

The linkage can be pivotally interconnected to an arm mounted to the frame at a selected pivot point for pivoting in a back and forth direction around the selected pivot point, the arm being readily manually graspable by the user on one side of the pivot point for exerting force in a forward or backward direction to forcibly cause the arm to pivot, the interconnection between the arm and the linkage being arranged such that the user's exertion of force on the arm in a forward or backward direction drives the rear linkage to travel along the ramp.

The linkage can be drivable back and forth along the path of travel on the ramp by the user's forcibly driving the user's foot in a back and forth direction while standing upright on the foot support.

The arm can have a handle disposed on the one side of the select pivot point for manual pivoting of the arm around the select pivot point by the user grasping and exerting forward or backward force on the handle, and the arm can be linked to the linkage through an arm linkage pivotably connected to the arm on the one side of the selected pivot point.

The arm can be linked to a resistance mechanism through a first crank, and the first crank can be pivotably interconnected to the resistance mechanism through a second crank.

The linkage can be linked to a resistance mechanism through a first crank, and the first crank can be pivotably interconnected to the resistance mechanism through a second crank.

The linkage can interconnected to a forward linkage, the forward linkage is interconnected to a resistance mechanism through a crank.

The arm can be connected to a forward linkage that is interconnected to the linkage.

The linkage can be interconnected to a forward linkage, and the forward linkage can be connected to the arm linkage and a crank.

The first crank can be interconnected to a second crank.

A resistance mechanism can be interconnected to the adjustment device, the adjustment device being operative to pivot the resistance mechanism to define a user selected segment of the master arcuate path of travel.

The foot support can be supported in a cantilevered arrangement on a rear linkage, the adjustment mechanism being adjustably interconnected to the cantilevered rear linkage through one or more other linkages, the adjustment mechanism being operable by the user to select any one of the plurality of different segments of the master arcuate path of travel.

The rear linkage can form one of the linkages of a four bar linkage, the four bar linkage further comprising a bottom linkage and a front linkage that are pivotally interconnected to the rear linkage for back and forth movement, the foot support being mounted on or to the bottom linkage in the cantilevered arrangement rearward of the rear linkage.

The front linkage of the four bar linkage can be connected to an arm that reciprocally rotates together with the back and forth movement of the front linkage, the arm being interconnected to a resistance mechanism.

The resistance mechanism can comprise a wheel mechanism.

The arm can be pivotally interconnected to a link that is pivotally interconnected to the resistance mechanism.

A manually graspable input arm pivotably can be interconnected to the foot support such that the arm pivots forwardly together with forward and upward movement of the foot support and rearwardly together with backward and downward movement of the foot support.

The adjustment device can be connected to the foot support via a bell crank.

A manually graspable input arm pivotably can be interconnected to a foot support such that the arm pivots forwardly together with forward and upward movement of the foot support and rearwardly together with backward and downward movement of the foot support, wherein the foot support is supported in a cantilevered arrangement on the linkage.

The frame linkage can include an arrangement of left and right front, bottom and rear linkages pivotally interconnected to each other, the foot supports being mounted on the bottom linkages rearward of the rear linkage.

The foot support can be interconnected to the resistance assembly via a bell crank.

BRIEF DESCRIPTION OF THE DRAWINGS

The above and further advantages of the invention may be better understood by referring to the following description in conjunction with the accompanying drawings in which.

DETAILED DESCRIPTION

Figure 1:
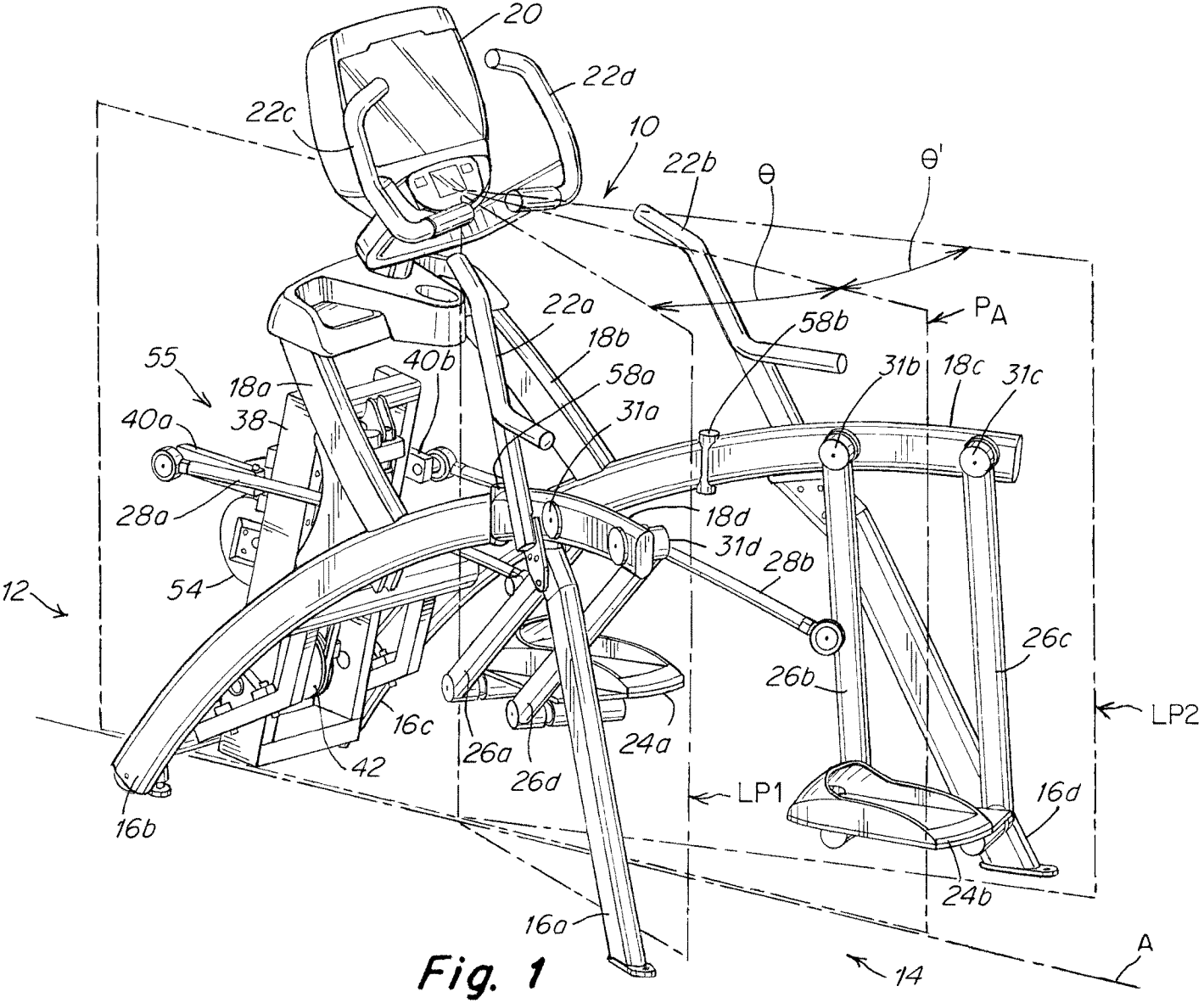
FIG. 1 is a rear perspective view of a device in accordance with the invention.

FIG. 1 is a perspective view of an exercise device in accordance with the present invention. The device includes a frame 10 having a front region 12, a rear region 14, "legs" 16*a*, 16*b*, 16*c* and 16*d*, and upper supports 18*a*, 18*b*, 18*c*, and 18*d*. Upper supports 18*c* and 18*d* comprise the upper links of a pair of four bar linkages (comprised on the right side of the apparatus, for example, of top bar 18*c*, pivotable linkages 26*a*, 26*c* and foot support mounting plate 62 that is mounted to mounting rods 74 extending from the distal ends of linkages 26*a*, 26*c*) and part of the arcuate portion of the frame, terminate in legs 16*c* and 16*b* respectively and are an integral part of frame 10. A display/control panel 20 and hand grips 22*a*, 22*b*, 22*c* and 22*d* are secured to the frame 10.

Frame 10 includes a front to back generally vertical planar axis PA that extends longitudinally from front to back A. Generally vertical planar axis PA and longitudinal axis A generally intersects a median of an upper torso of the user when the user is disposed in the generally upright position on the device. As describe below with reference to FIG. 6, the pivotable linkage arranged on frame 10 guide foot supports 24*a*, 24*b* along a master arcuate path of travel that is oriented at a selected lateral angle relative to the generally vertical planar axis PA and longitudinal axis A, where the master arcuate path of travel extends between a forwardmost upward lateral position and a reawardmost downward lateral position.

Foot supports 24*a* and 24*b* are sized to receive the foot of a user. Foot supports 24*a* and 24*b* are movably connected to, and supported by, forward linkages or legs 26*a* and 26*b*, and rear linkages 26*c* and 26*d*. Linkages 26*a*-26*d* are movably connected to the rear region 14 of frame 10 by upper supports or links 18*d* and 18*c*. Although the device is shown with opposing pairs of linkages supporting each foot support, other embodiments are contemplated having fewer or more linkages supporting and controlling the range and path of motion of foot supports 24*a* and 24*b* associated with the linkage(s).

The foot supports 24*a* and 24*b* approximate a shod human foot in size and shape. They can include a non-skid surface and be bounded by one or more low lips to help a shoe remain in place on the foot supports during use. Alternately, straps may maintain each foot within the foot support to further retain the user's foot in place during use. However, as used herein, a "foot support" can also encompass any designated support such as a pedal, a pad, a toe clip, or other foot/toe/leg and device interface structure as is known in the art.

The forward linkages or legs 26*a* and 26*b* are movably connected to drive linkages 28*a* and 28*b*; and the drive linkages are in turn connected to other elements. In other embodiments, the drive linkages 28*a* and 28*b* are connected directly to the foot supports 24*a* and 24*b*. Additionally, "foot supports" can be on or integral to either the forward linkages or to the one or more linkages joined to the frame.

As illustrated in FIG. 1, representative movable connectors 31*a*, 31*b*, 31*c*, and 31*d* include pivot assemblies, as known in the art, that provide very smooth and easy relative rotation or reciprocal motion by elements joined by the pivot assemblies. Movable connectors 31*b* and 31*d* rotatably couple forward linkages or legs 26*b* and 26*a*, respectively, to upper supports or links 18*c* and 18*d*. Movable connectors 31*c* and 31*a* rotatably couple rear linkages 26*c* and 26*d*, respectively, to upper supports or links 18*c* and 18*d*. Other connection assemblies that permit similar motion are contemplated by the invention. The movable connectors allow for a smooth and controlled swinging of foot supports 24*a* and 24*b* in an arcuate path. The arcuate path can be laterally offset at an angle relative to the longitudinal axis A of frame 10 by adjustable hinges 58*a* and 58*b* as described in FIG. 6.

Figure 2:
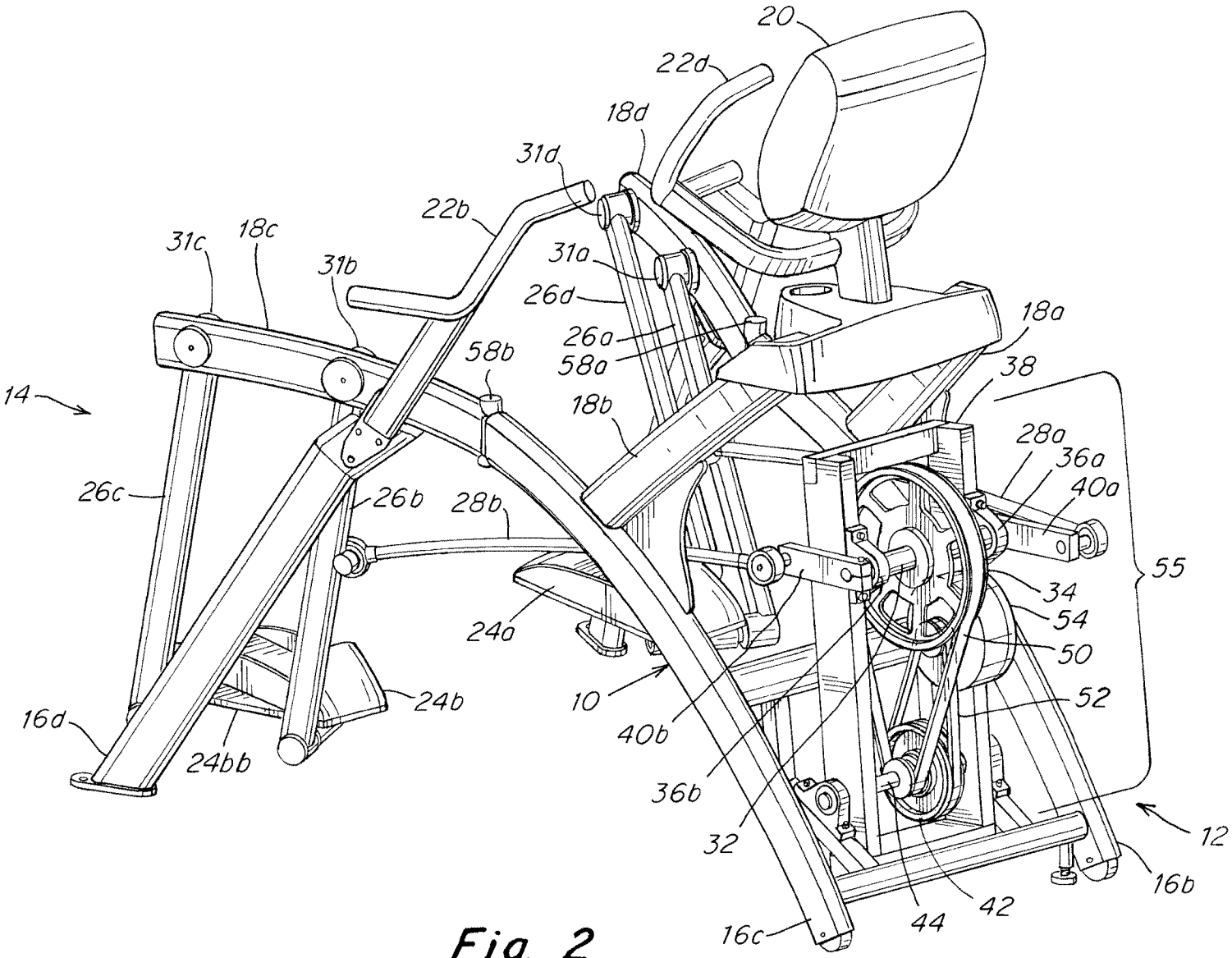
FIG. 2 is a front perspective view of the device of FIG. 1.
Figure 3:
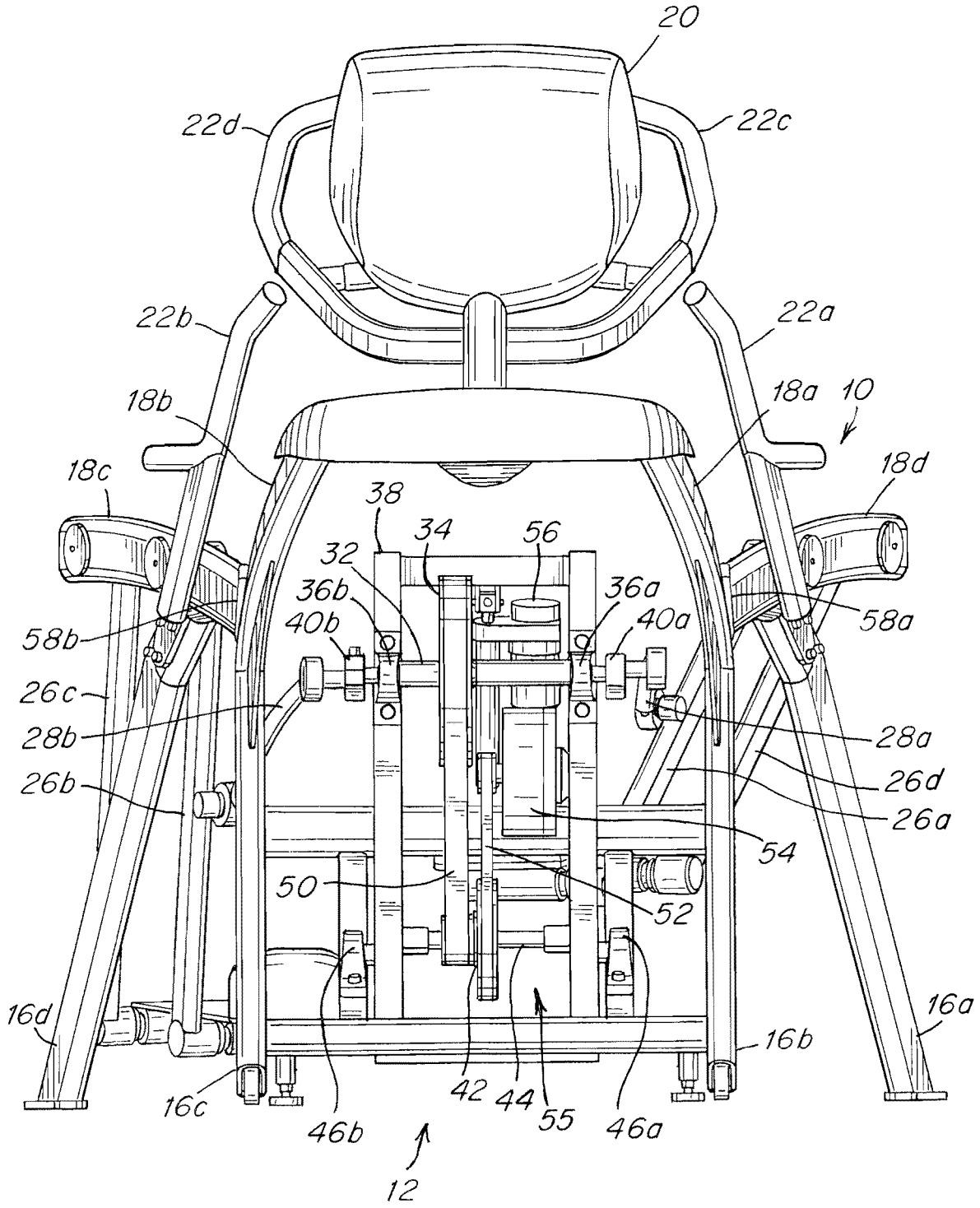
FIG. 3 is a front view of the device of FIG. 1.

FIG. 2 is a front perspective view of the device of FIG. 1 illustrating internal elements of a resistance assembly 55. As illustrated, the forward ends of drive linkages 28*a* and 28*b* are shown attached to crank arms 40*a* and 40*b*, which are connected to a crankshaft 32 that turns a pulley 34 mounted on the crankshaft 32. Top bearings 36*a* and 36*b*, shown in FIG. 3, receive the crankshaft 32 are secured to a mounting 38. Crank arms 40*a* and 40*b* are secured to each end of the crankshaft 32 and are movably coupled to the drive linkages 28*a* and 28*b*, respectively, as is known in the art. A second pulley 42, rotatably mounted on stationary shaft 44, which is mounted to frame member 38, is coupled to the pulley 34 with a belt 50. A second belt 52 couples the second pulley 42 to a brake assembly 54, which includes a rotatable mass such as a flywheel or an electromechanical brake (e.g., an eddy current brake) secured to the mounting 38.

As shown in FIG. 2, the mounting 38 pivots around bottom bearings 46*a* and 46*b* so as to be rotatable fore and aft. A motor 56 (shown in FIG. 4) or supplemental motor (not shown), responsive to input from the display/control panel 20, can act as a tilt actuator to tilt the mounting 38 and the elements affixed thereto. In one embodiment the motor 56 or supplemental motor (not shown) can be adapted to be responsive to input from a user interface or display/control panel 20 where the motor 56 acts to drive a tilt actuator such as a pneumatic or hydraulic or electric actuator 56*a* that has a controllably extendible piston or screw 56*p* driven by the motor 56, the extendible piston or screw 56*p* acting on extension or retraction to tilt the mounting 38 back and forth and the elements affixed thereto thus adjusting the selection of arc segment depending on the degree of tilting of the mount 38 and associated pulley 34 and second pulley 42. Thus the controllable operation of the motor 56 effects controllable and selective tilting of the mounting 38 and concomitantly the forward to backward tilt or pivot position of the resistance device 55 resulting in selection of an arc segment having a unique selectable height H1, H2, path of travel AP, AP', forwardmost position FM1, FM2 and rearwardmost position RM1, RM2 in the same manner as shown and described herein with reference to FIGS. 10, 11. The motor 56 and associated components can alternatively be substituted for by a manual arc selection mechanism such as a screw 225 as described with reference to FIGS. 12, 12A.

As shown, the pulley 34, the second pulley 42 and the resistance assembly 55 including a brake 54 rotate about an axis that is orthogonal to the longitudinal axis A of the frame 10. It should be clear from the above description of the drive system that both foot supports 24*a* and 24*b* are synchronized together by the motion of crankshaft 32. It should also be noted that there are no clutches between crankshaft 32 and brake assembly 54. This is done to allow the inertia of brake assembly 54 within resistance assembly 55 to assist the foot supports 24*a* and 24*b* through the weaker portion of the range of motion of the user's leg.

Although the brake assembly 54 is the preferred component in resistance assembly 55, various other braking devices such as known to those skilled in the art can be associated with the rotatable elements to inhibit rotation thereof. The braking device may include but is not limited to any of the following: friction and air resistance devices such as fans, pneumatic or hydraulic devices, as well as various other types of electromechanical braking devices. This list is by no means exhaustive and represents only a few examples of resistance mechanisms that may be incorporated into the present invention. One configuration disclosed herein uses a flywheel and eddy current brake which promotes a smooth, bilateral, reciprocal motion that is easily maintained by a device user. Further, resistance assembly 55 can be enclosed within a housing to protect the user from the internal elements of resistance assembly 55. An alternative resistance assembly can comprise a fan 54*a*, FIGS. 10, 11 that exponentially increases the degree resistance with the increase in speed of rotation of the fan 54*a*.

The resistance or brake mechanism 54, 54*a* can comprise a mechanism that increases resistance exponentially with the increase in degree of speed or velocity of travel of the foot supports 24*a*, 24*b* or with the degree of increase in speed or velocity of movement of the resistance mechanism itself.

Figure 4:
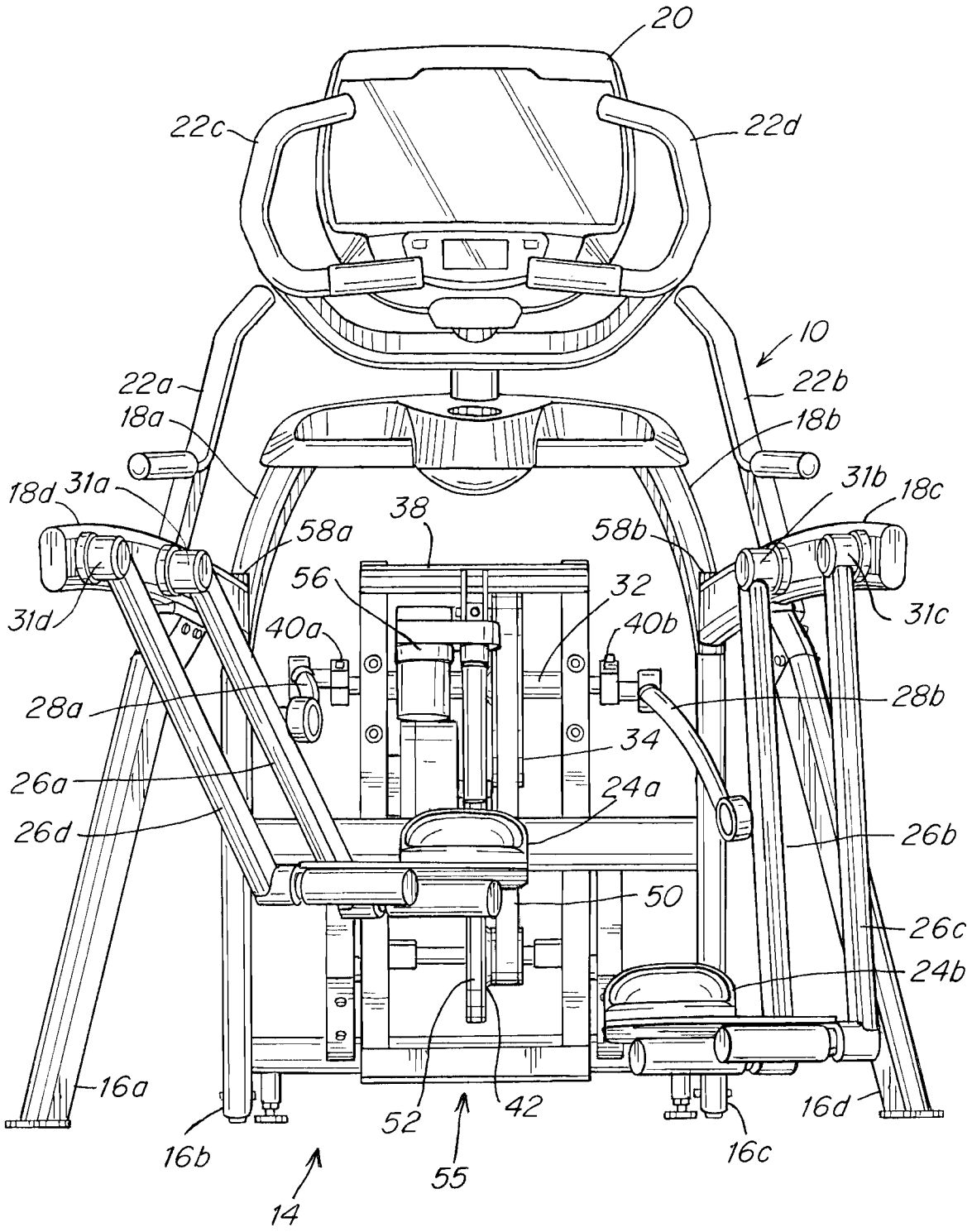
FIG. 4 is a rear view of the device of FIG. 1.

FIG. 4 is a rear view of the device of FIG. 1. The illustration in FIG. 4 is how a user would view the device upon mounting. Foot supports 24*a* and 24*b* are positioned to allow the user to place his or her feet on the foot supports. As described above, clips or straps may be used to firmly secure the user's feet within their respective foot supports. Drive linkages 28*a* and 28*b* are coupled to either side of resistance assembly 55. Crankshaft 32 is connected to each of the drive linkages via crank arms 40*a* and 40*b*. Handles 22*a*, 22*b*, 22*c* and 22*d* allow the user to steady themselves while the user's legs move in an arcuate path of motion.

Monitor 20 may include displays and controls to allow the user to manipulate the intensity of the resistance to create an easier or more difficult exercise routine and to adjust the motion path of the foot supports to one that is more inclined or less inclined.

Figure 5:
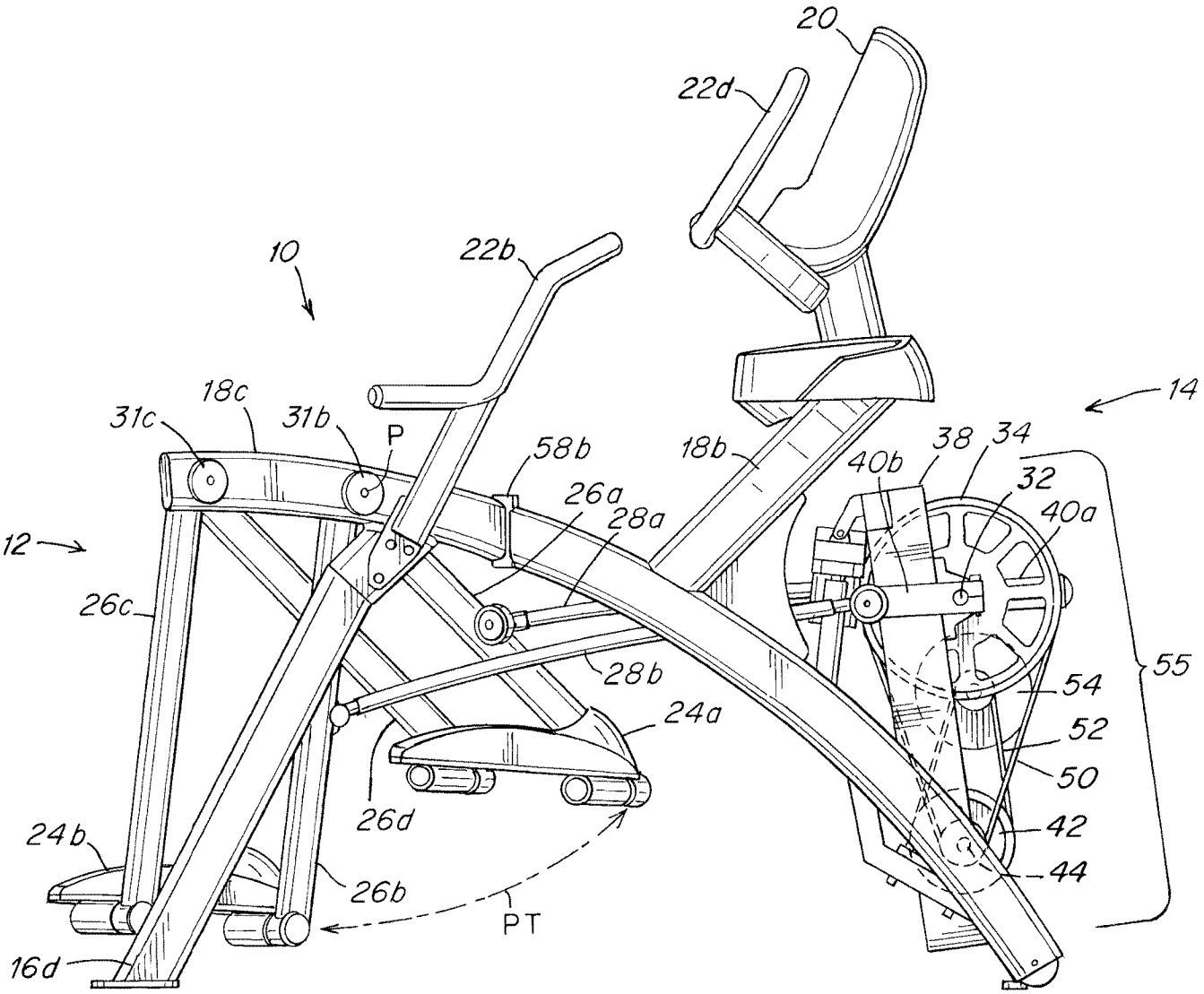
FIG. 5 is a side view of the device of FIG. 1.

FIG. 5 is a side view of the device of FIG. 1. In this view, the foot supports 24*a* and 24*b*, forward linkages or legs 26*a*, 26*b* and rear linkages or legs 26*c*, 26*d* are presented from a perspective that allows ready visualization of the path that foot supports 24*a* and 24*b*, and thus a user's feet, will traverse as the foot supports move fore and aft while suspended from the forward and rear linkages. It will be noted that as foot supports 24*a* and 24*b* move fore and aft, the forward and aft limit of motion is not unbounded. Rather, the range of motion is defined by the length of the crank arms 40*a* and 40*b* (shown in FIG. 2), which provide an appropriate stride length. Further, because the foot supports 24*a* and 24*b* are pivotally connected to, and swing with, the forward linkages 26*a*, 26*b* and rear linkages 26*c*, 26*d*, the foot supports travel a curved or arcuate path, and not an elliptical path, to provide more favorable biomechanics.

The motion path for the foot supports 24*a* and 24*b* can also be altered by adjusting the position of mounting 38. As described above, the mounting 38 is pivotally mounted to the frame member and pivots fore and aft upon command. As is evident by reference to the Figures, pivoting the mounting 38 forward moves the components secured directly or indirectly thereto forward. Likewise, pivoting the mounting 38 rearward causes the components secured directly or indirectly thereto to move rearward. This repositioning causes the motion path of the foot supports 24*a* and 24*b* to move to a different location along an arcuate path around a point of rotation "p", shown here between pivot assemblies 31*b* and 31*c*, at a distance established by the length of the forward and rear linkages or legs 26*a*, 26*b*, 26*c* and 26*d*. Thus, the specific location on the arc or arc segment ("the motion path") is user selectable to increase or decrease stride angle and location from a number of user selectable points, or arc segments P1, AP, P2, AP' defined around the point of rotation. Further, as described in FIG. 6, the motion path has a lateral offset at an angle θ, θ' relative to the longitudinal axis A, AP of frame 10 that is adjustable via pivot mechanisms where a forward end of the upper links 18*c*, 18*d* of the linkage assemblies 18*c*, 26*b*, 26*c*, 24*b* and 18*d*, 26*a*, 26*d*, 24*a* are laterally pivotably connected to the frame via a pivot mechanism such as hinges 58*a* and 58*b*.

In operation, a user approaches the device from the rear region 14, grasps the hand grips 22*a* and 22*b*, and places a foot on each of the foot supports 24*a* and 24*b*. The user's feet and legs begin to move fore and aft in a comfortable stride. The user selects an exercise program or manually adjusts the device by imputing commands via the display/control panel 20. In response to the command input, the resistance to fore and aft movement of the foot supports 24*a* and 24*b* can be altered by impeding rotation of the pulleys 34, 42 or flywheel. Also, in response to command, input, the mounting 38 is moved fore or aft. As shown, when the mounting 38 moves forward, the motion path of the foot supports is on a more inclined or vertical define arc segment. To discontinue use of the device, a user simply stops striding, thereby causing the movement of the device to stop, and dismounts from the foot supports.

Figure 6:
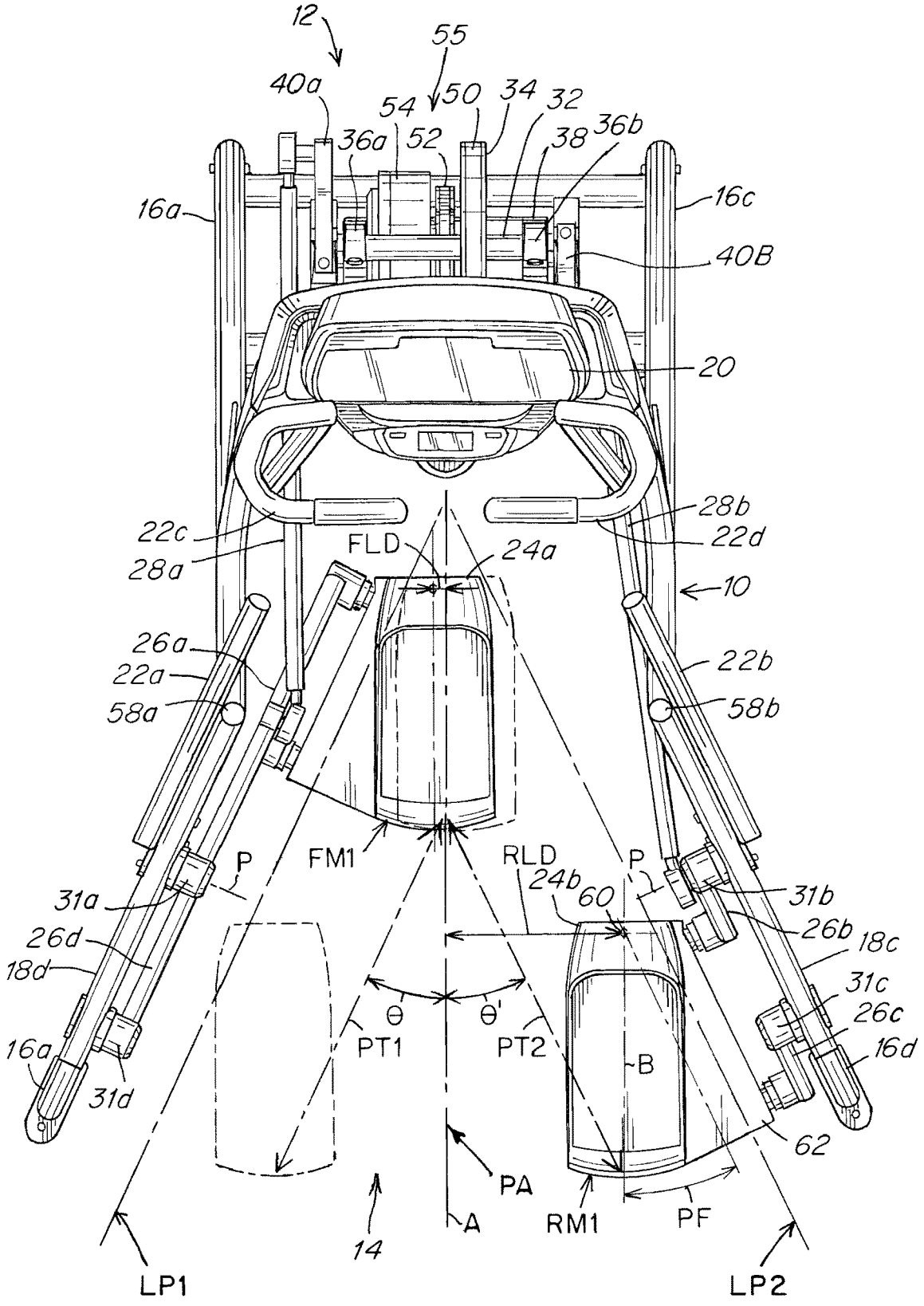
FIG. 6 is a top view of the device of FIG. 1.

FIG. 6 illustrates a top view of the device of FIG. 1. As illustrated, foot support 24*a* can move back and forth in an arcuate motion along path PT1. Similarly, foot support 24*b* can move back and forth in an arcuate motion along path PT2. Each of paths PT1, PT2 can be laterally offset at an angle relative to a longitudinal axis A of the frame. For instance, FIG. 6 shows path PT1 offset at an angle θ, and path PT2 offset at an angle θ'. Preferably, angles θ, θ' are equivalent such that paths PT1, PT2 are mirrored across longitudinal axis A of the frame. Angles θ, θ' can also be adjusted via adjustable hinges 58*a*, 58*b*, respectively. In this manner, angles θ and θ', and therefore the arcuate motion along paths PT1 and PT2, can be varied between about 0° (i.e., parallel with longitudinal axis A) and about 35°.

As foot supports 24*a*, 24*b* move along paths PT1, PT2, it is preferable that a longitudinal axis B of the foot supports remains parallel with longitudinal axis A of the frame. Thus, the horizontal orientation of each of foot supports 24*a*, 24*b* can be manually or automatically adjustable to compensate for lateral offset angles θ, θ'. For instance, FIG. 6 shows path PF along which foot support 24*b* can be rotated to keep longitudinal axis B parallel with longitudinal axis A of the frame.

Although FIG. 6 depicts a specific embodiment of the present invention, it would be apparent to those skilled in the art that various modifications can be made without departing from the spirit of the disclosure. For example, adjustable hinges 58*a* and 58*b* can be disposed at varying locations along the frame. Moreover, other configurations, such as adjustable foot supports, can be used together with or in place of hinges 58*a*, 58*b* to create a lateral offset angles θ, θ' in the arcuate motion of foot supports 24*a*, 24*b*. Further, although paths PT1 and PT2 depict a straight path when looking down on the arcuate motion, it should be appreciated that a degree of inward curvature (i.e., curvature toward longitudinal axis B) or outward curvature (i.e., curvature away from longitudinal axis B) can be introduced.

As shown in FIG. 6, the foot supports 24*a*, 24*b* are pivotably mounted at a front edge or point 60 to a foot support plate 62 that ties the distal ends of the pivotable linkages 26*b*, 26*c* together to form a four bar linkage. The front edge or point 60 is disposed along and intersects the longitudinal axis B of the foot supports 24*a*, 24*b*. The frame 10 and linkage assemblies are arranged such that a front edge or point 60 of the foot support longitudinal axis B when disposed in the rearwardmost RM1, RM2 position is spaced a rear lateral distance RLD from the vertical planar axis PA of the device that extends from four inches to three feet as measured along a line that is normal to or intersects the generally vertical planar axis (PA) at ninety degrees.

Also as shown in FIG. 6, the front edge or point 60 of the longitudinal axis B of the foot supports 24*a*, 24*b*, when disposed in the forwardmost FM1, FM2 position is spaced a forward lateral distance FLD from the vertical planar axis PA that is at least three inches less than the rear lateral distance (RLD), typically 3 inches to 3 feet less, and preferably 8 inches to 3 feet less, measured along a line that is normal to or intersects the generally vertical planar axis (PA) at ninety degrees.

Figure 6A:
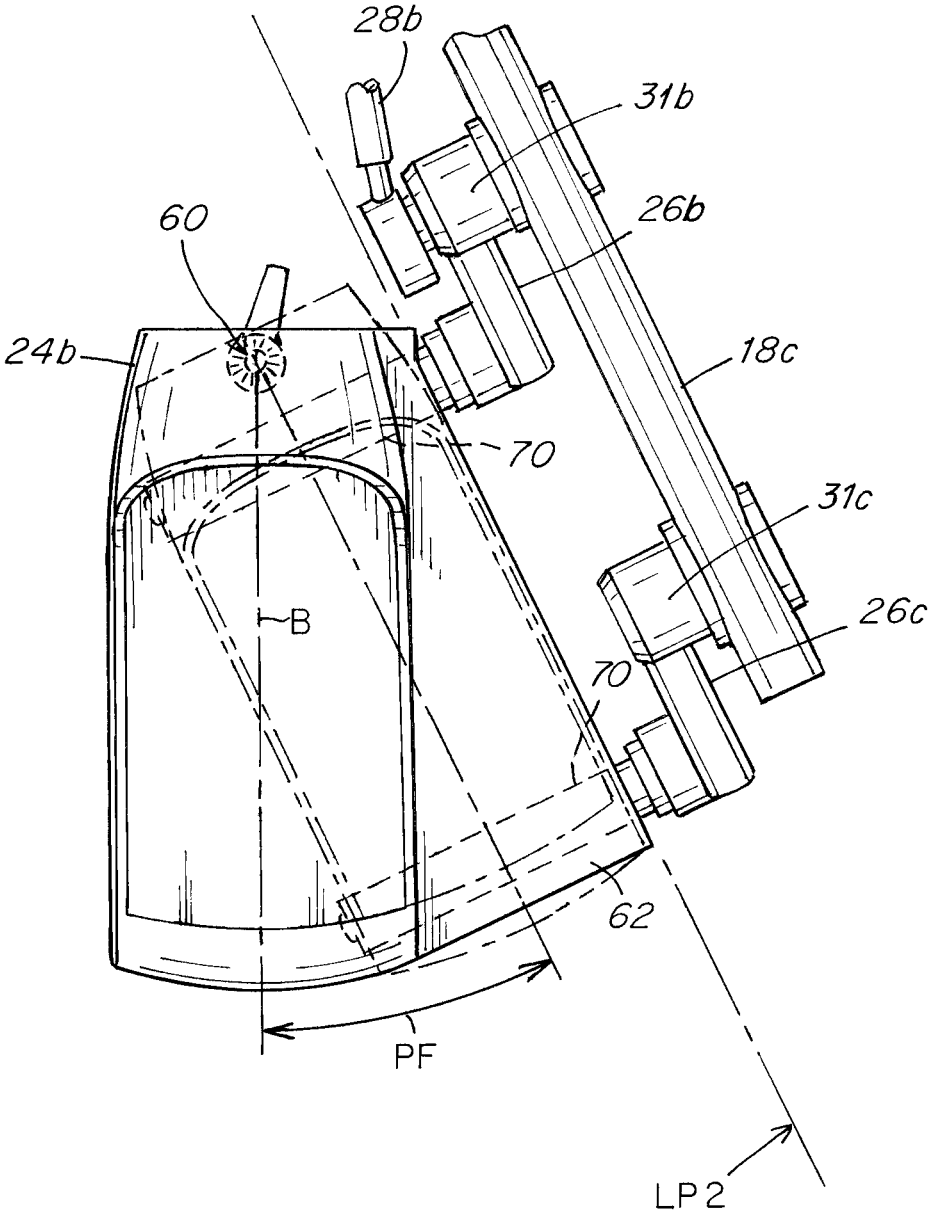
FIG. 6A is a top plan view of the right foot support and four bar linkage assembly of the device of FIG. 1.
Figure 6B:
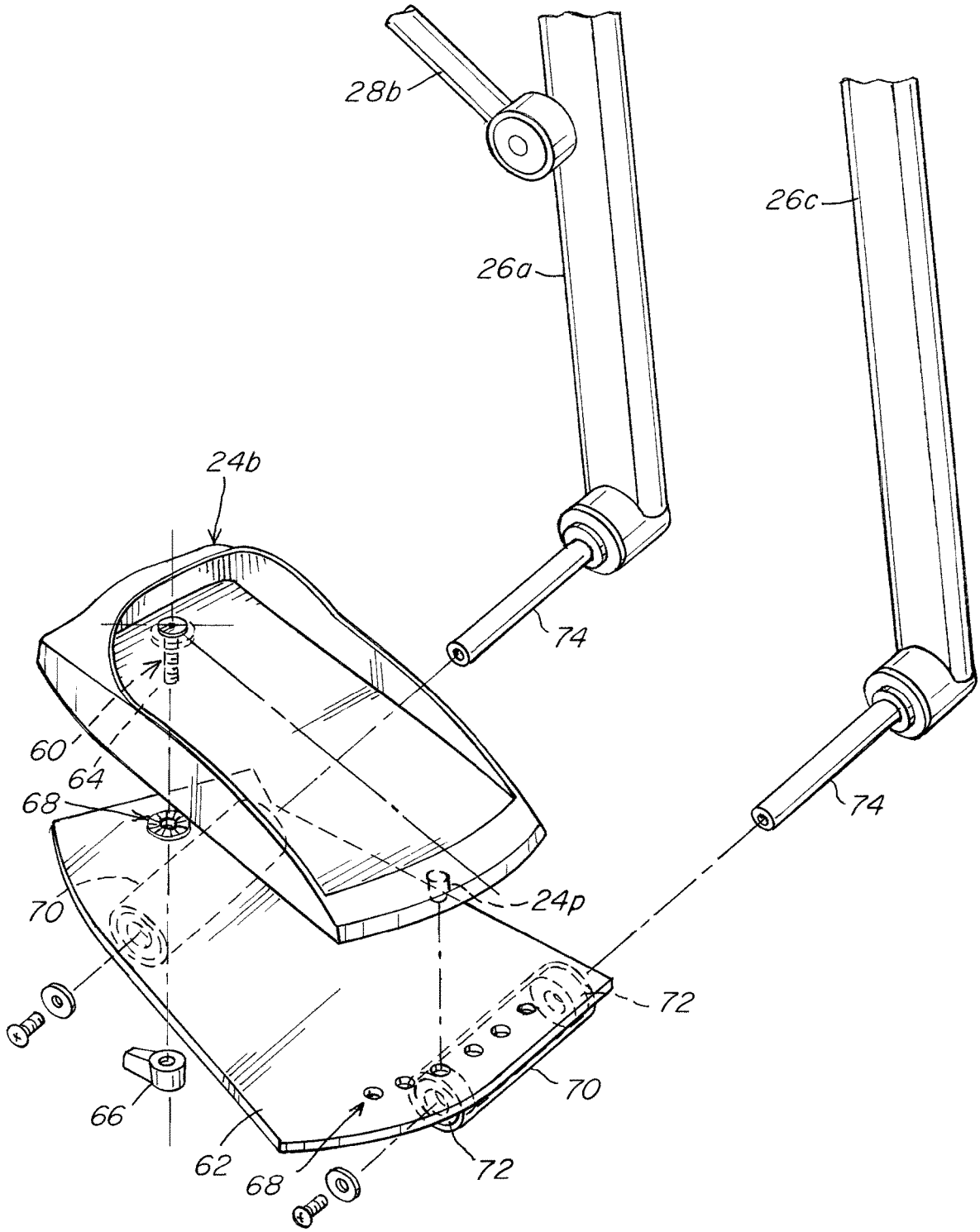
FIG. 6B is a left exploded perspective view of the components shown in FIG. 6A.

FIGS. 6A, 6B illustrate one embodiment of four bar linkage where a support plate 62 forms the bottommost link of a four bar linkage formed by an upper link 18*c*, a pair of pivotable leg linkages 26*b*, 26*c* and the support plate 62. As shown, a foot support 24*b* is pivotably mounted on the upper surface of the support plate 62 for pivoting around the mounting aperture 60. The support plate 62 is a rigid structure such that it can act as a linkage within the four bar linkage. A pair of mounting tubes 70 are attached typically via welding to the undersurface of the plate 62 and include a pair of rotatable bearings 72 through which mounting rods 74 extending from the distal ends of legs 26*b*, 26*c* are insertable such that plate 62 can be rotatably mounted to the distal ends of legs 26*b*, 26*c* and form the lower link of the four bar linkage. In the embodiment shown, the support plate 62 is provided with positioning adjustment apertures 68 for receiving a pin 24*p* that extends from the undersurface of foot support 24*b*, the pin 24*p* fixing the angular position or orientation of the support 24*b* relative to the support plate 62 when inserted into one of the apertures 68 such that the foot support does not freely rotate around aperture 60. An exemplary means of adjusting the angle of the foot supports is shown in FIG. 6B, an exploded perspective view of the foot support of FIG. 6A. As shown in FIGS. 6A & 6B, the foot supports 24*a*, 24*b* may be adjustable through an angular range, PF, of around 25 degrees. The foot supports 24*a*, 24*b* are pivotally mounted 60 to baseplates 62. Threaded posts 64 can be provided on the underside of the foot supports 24*a*, 24*b* which can be loosened or clamped by means of thumbnuts 66 to allow the foot supports 24*a*, 24*b* to be selectively indexed to a desired angle PF by indexing means 68. The baseplates 62 have bearing tubes 70 affixed to their undersides. The bearing tubes have bearings 72 mounted at each end that in turn are supported on spindles or axles 74 which are affixed to the lower ends of linkages 26*a*-26*d* such that the baseplate 62 remains generally parallel to the ground when the linkages are pivoted back and forth from front to back and back to front. The angular fixing of the foot supports relative to the baseplates 62 is preferred so that the risk of the user's losing balance or control of their footing is minimized.

Figure 7:
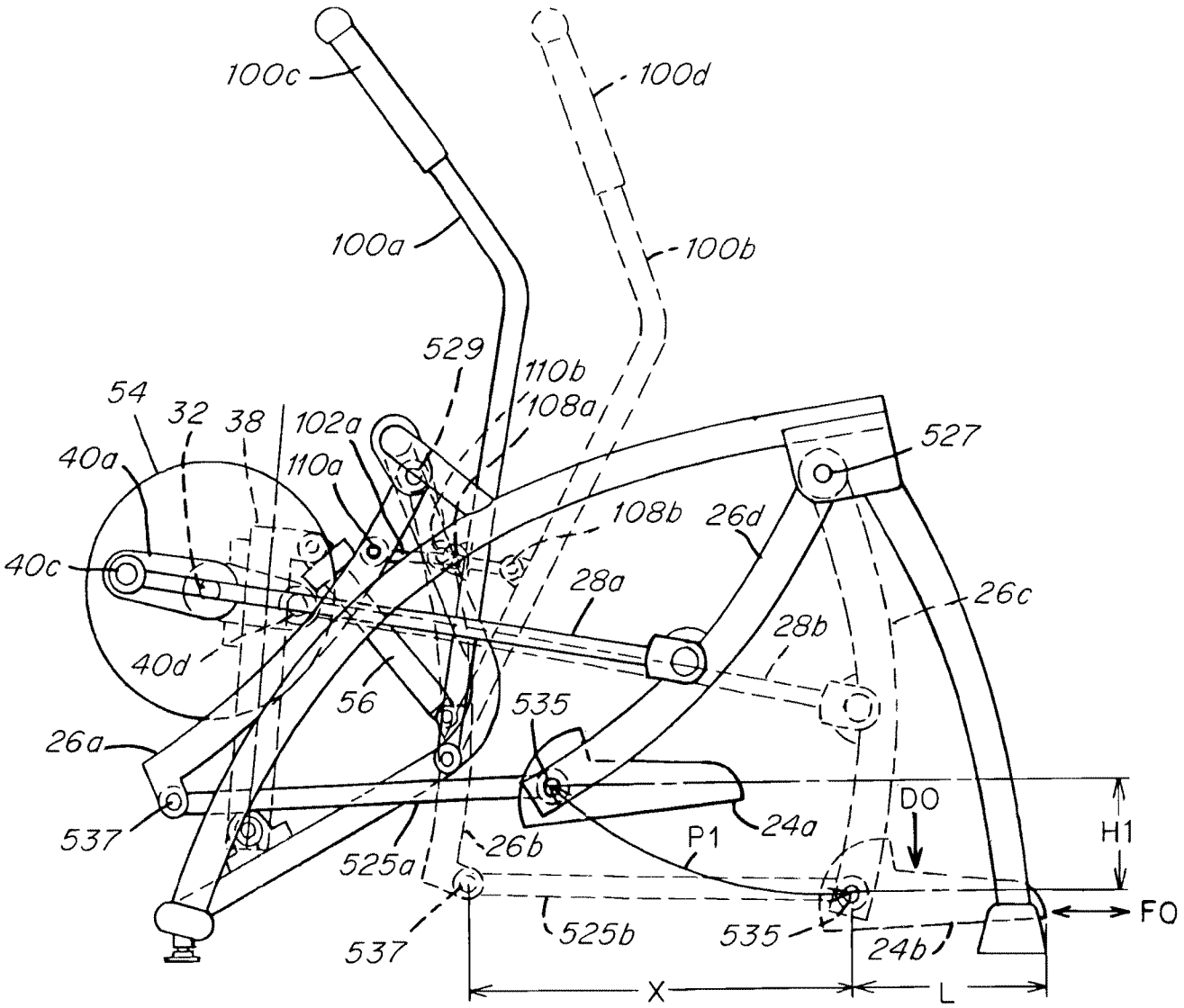
FIG. 7 is a is a side view of an apparatus in accordance with an exemplary embodiment of the present invention having a cantilevered foot support.
Figure 8:
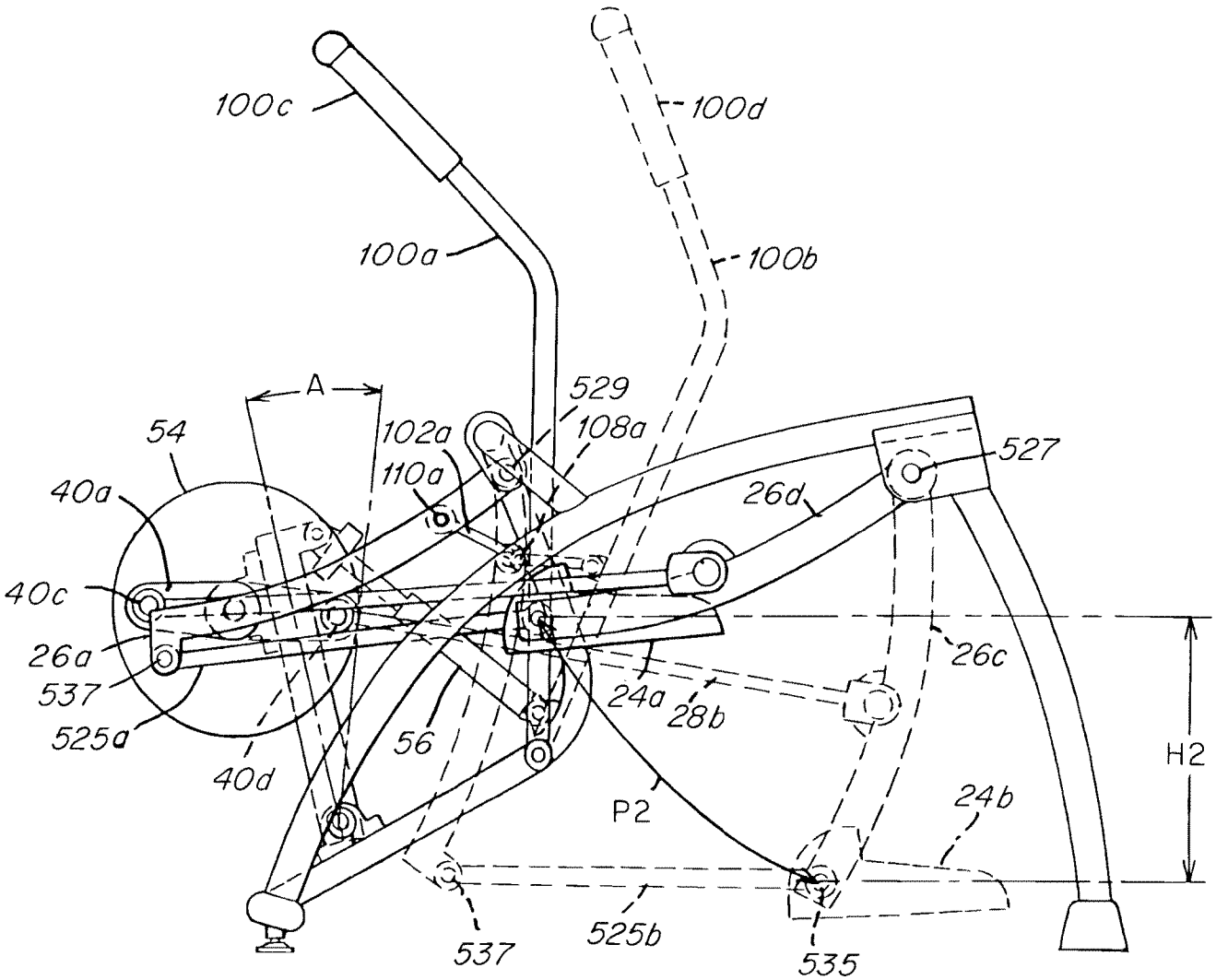
FIG. 8 is a side view of the device of FIG. 7 adjusted to have an arc segment path of a greater incline.

FIGS. 7 and 8 illustrate another embodiment of the present invention. In this embodiment, the handles 100*c*, 100*d* and arms 100*a*, 100*b* follow the front to back movement of the foot supports 24*a*, 24*b* with a pivoting front to back or back to front movement. That is, when the right foot support 24*a* moves forwardly the right handle 100*c* and arm 100*a* pivot or move forwardly, and when the right foot support 24*a* moves backwardly the right handle 100*c* and arm 100*a* pivot or move rearwardly. Similarly, when the left foot support 24*b* moves forwardly the handle 100*d* and arm 100*b* pivot or move forwardly, and when the left foot support 24*b* moves rearwardly the handle 100*d* and arm 100*b* pivot or move rearwardly. As shown the frame linkage assembly generally moves forwardly and backwardly together with forward and backward movement of the input handles and arms. The degree of front to back pivoting of the arms 100*a*, 100*b* can be predetermined at least by selective positioning of the pivot joints 108*a*, 108*b*, 110*a*, 110*b*, selective positioning of the mount 104 and selection of the lengths of linkage arms 102*a*, 102*b*.

In the embodiments shown, the user can reduce or transfer the amount of energy or power required by the user's legs and/or feet to cause the foot supports to travel along the arcuate path P1, P2 from back to front by pushing forwardly on the upper end of the arms 100*a*, 100*b* during the back to front movement. And, the user can increase the speed of forward movement by such pushing, or reduce the speed and increase the power or energy required by the legs to effect forward movement by pulling. Conversely, the user can reduce or transfer the amount of power or energy required to cause the foot supports to move from front to back by pulling backwardly on the upper end of the arms. And, the user can increase the speed of rearward movement by such pulling or reduce the speed by pushing, or reduce the speed and increase the power or energy required by the legs to effect rearward movement by pushing.

The linkage and foot support assemblies, 24*a*-*b*, 26*a*-*d*, 18*e*-*f* that are pivotably linked via the linkages 102*a*, 102*b* to the pivotably mounted arms 100*a*, 100*b* can be configured to enable the foot support and the plane in which the sole of the foot is mounted to either not rotate or to rotate/pivot to any desired degree during front to back movement by preselecting the lengths of each and any of the links 26*a*-*d*, 18*e*-*f* appropriately to cause the desired degree of rotation/pivoting.

As illustrated in FIGS. 7 and 8, drive linkages 28*a* and 28*b* are interconnected to brake 54 at opposing 180 degree circle positions 40*c*, 40*d* from the center of rotation of the shaft 32 and crank arms 40*a*, 40*b* of brake 54, i.e. the linkages are connected at maximum forward and maximum rearward drive positions respectively. This 180 degree opposing interconnection causes foot supports 24*a* and 24*b* to always travel in opposite back and forth directions, i.e. when the right foot support is traveling forward the left foot support is traveling backwards and vice versa. Similarly, the pivotably mounted arms 100*a* and 100*b* are interconnected to the brake 54 such that when the right arm is moving forward the left arm is moving backward and vice versa.

In any event, foot supports 24*a*, 24*b* and input arms 100*a*, 100*b* are linked to the resistance assembly such that when the left side components (i.e., left foot support and associated input arm) are traveling forward the right side components (i.e. right foot support associated input arm) are traveling backward for at least the majority of the travel path and vice versa.

In the same manner as forward or backward pivoting of the mounting member 38 changes the degree of incline, height and/or path of travel of foot supports 24*a*, 24*b* as described above, a forward or backward pivoting of the mounting member 38 also changes the degree of back to front pivoting and/or the degree of path of travel of arms 100*a*, 100*b*. Thus, in the same manner as the user is able to select the degree of incline of the path of travel of the foot supports, e.g. arc path P1, P2, the user is able to select the degree, length, path of travel of back to front, front to back pivot stroke or travel path of input arms, 100*a*, 100*b*, by adjusting the front to back pivot position of the linkage 102 *a*, 102*b*.

As shown, the vertically disposed links 26*a-d* of the four bar linkage are pivotally connected and supported at upper pivot points, e.g., points 527, 529 on the frame members 18*e-f* and pivotally connected to the lower linkages 525*a-b* at lower pivot points, e.g., points 535, 537.

As shown in FIG. 7, the longitudinal lengths L of the foot supports 24*a*, 24*b* extend beyond and rearwardly of the lower inside lengths X of the lower four bar linkages 525*a*, 525*b* and thus beyond, i.e., rearwardly of the pivot points 535 at which the lower linkages 525 *a-b*, are pivotally connected to the rear linkages 26*c-d*. By such an arrangement, the foot supports 24*a* and 24*b* are cantilevered in their structure, function and movement relative to the four bar linkage assembly around lower pivot points 535. The load DO exerted on foot supports 24*a-b* by a user as shown is supported primarily by rear linkages 26*c, d* at the pivot connections 535.

The degree of leverage or cantileverage force exertable by exertion of a downward force DO on the foot supports 24*a* and 24*b* around the pivot points 535 can be varied by variably selecting the overall distance by which the foot supports 24*a*, 24*b* extend beyond or rearwardly of the lower pivot points 535 of the four bar linkage assembly. As shown in FIG. 7, the rear end of the foot supports 24*a*, 24*b* are distanced away from the pivot points 535 by distance L. As shown the front terminal ends of the foot supports 24*a* and 24*b* are connected to the rear terminal ends of lower bar or linkages 525*a*, 525*b*, the maximum cantilever distance in the FIG. 7 embodiment being essentially the length L of the foot supports 24*a*, 24*b*. As can be readily imagined, the leverage/cantileverage force can be selectively varied by varying the distance by which the foot supports extend rearwardly of the pivot points 535.

Thus, by mounting or connecting the foot supports 24*a* and 24*b* to the lower bar/linkage such that some portion or all of the length of the foot supports extend rearwardly or beyond the position of the lower rear pivot points 535 of the four bar linkage, the user is provided with the ability to exert a lever or cantilever force when pushing downwardly DO or forwardly FO, FIG. 7 with the user's legs and/or feet on the top surface of the foot supports 24*a* and 24*b*. The degree of such leverage can be selected by preselecting the length L or the distance of mounting of the foot support from the pivot points 535. The longer the cantilever distance, the greater the cantilever or lever force that is exertable with the same amount of DO force.

Figure 9:
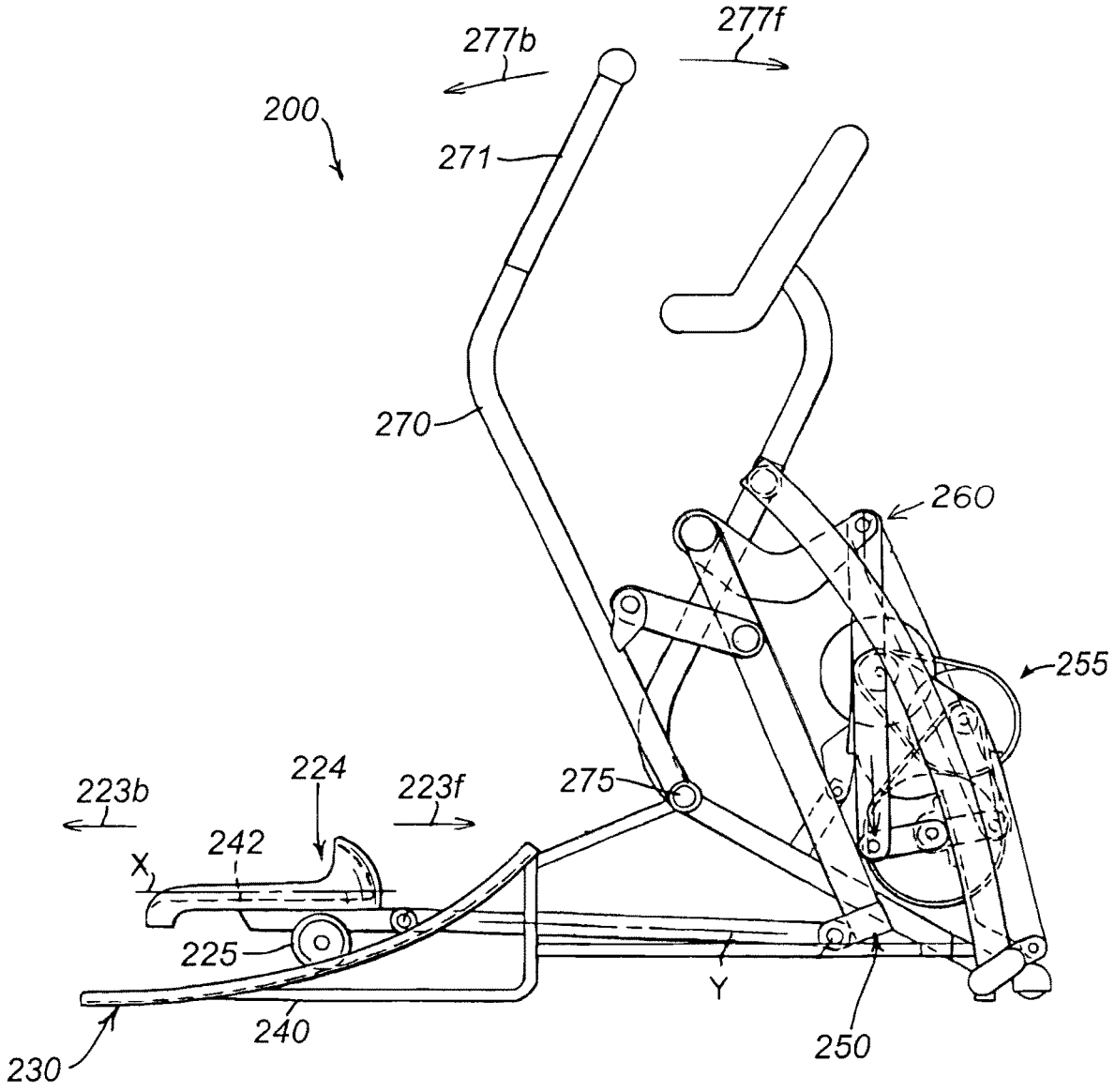
FIG. 9 is a side view of a device in accordance with another exemplary embodiment of the present invention having a curved ramp.

FIG. 9 illustrates another embodiment of the present invention in which foot supports 224 are movable along an arcuate path defined by corresponding ramps or rails 230 on which the foot supports 224 are typically rollably (e.g. on wheels 225 mounted to the underside of the foot supports 224) or slidably mounted for back and forth, up and down reciprocal movement along ramps 230. The path of the foot supports 224 on or along the ramps/rails 230 is arcuate and preferably laterally offset at an angle relative to the longitudinal axis A of apparatus 200. Further, the arcuate path is preferably the same identical arcuate path from front to back as from back to front in the course of an exercise cycle by the user of the apparatus 200.

In the embodiment of FIG. 9, the exercise apparatus 200 includes a stationary frame 240, a frame linkage assembly 250 pivotally/movably engaged with the frame 240, the one or more foot supports 224 being pivotally engaged with the frame linkage assembly 250. The apparatus includes a crank mechanism 260 pivotally engaged with the frame linkage 250. The crank mechanism 260 is typically connected an electromechanical and mechanical resistance mechanism 255 can provide resistance to back and forth motion of the foot supports.

The foot supports 224 have a generally planar support surface 242 for receiving the sole of a user-subject's foot. The foot supports 224 have a front to back center axis X and are pivotally interconnected to drive linkages that have a front to back center axis Y. During travel of the foot supports 224 and the drive linkages from back X1, Y1 to front X2, Y2 and from front X2, Y2 to back X1, Y1, the axes X and Y remain generally parallel to a fixed reference (e.g., ground).

With reference to FIG. 9, in operation, a user approaches the device from the rear region of the apparatus, then moves toward the front region of the apparatus and grasps the hand grips 271 of the input arms 270 which are pivotably mounted to the frame at pivot point 275 for back and forth 277*b*, 277*f* motion. The user then places a foot on each of the foot supports 224 and moves the user's feet in a forward 223*f* and backward 223*b* motion. The user can exert force in performance of the exercise by either forcibly moving the feet and legs on the supports 224 or by forcibly moving the handles 271 and arms 270 fore and aft. As a result of the arrangement of the linkage and other interconnections between foot supports 224 and the arms 270, when the user pushes the right arm 271 forward and pulls the left arm 271 backwardly the corresponding right foot support 224 is simultaneously forcibly moved forwardly and the corresponding left foot support 224 is simultaneously forcibly moved backwardly. Similarly, when the user pushes the right foot support 224 forward and pulls the left foot support 224 backwardly the corresponding right arm 270 is simultaneously forcibly moved forwardly and the corresponding left arm 270 is simultaneously forcibly moved backwardly.

Figure 10:
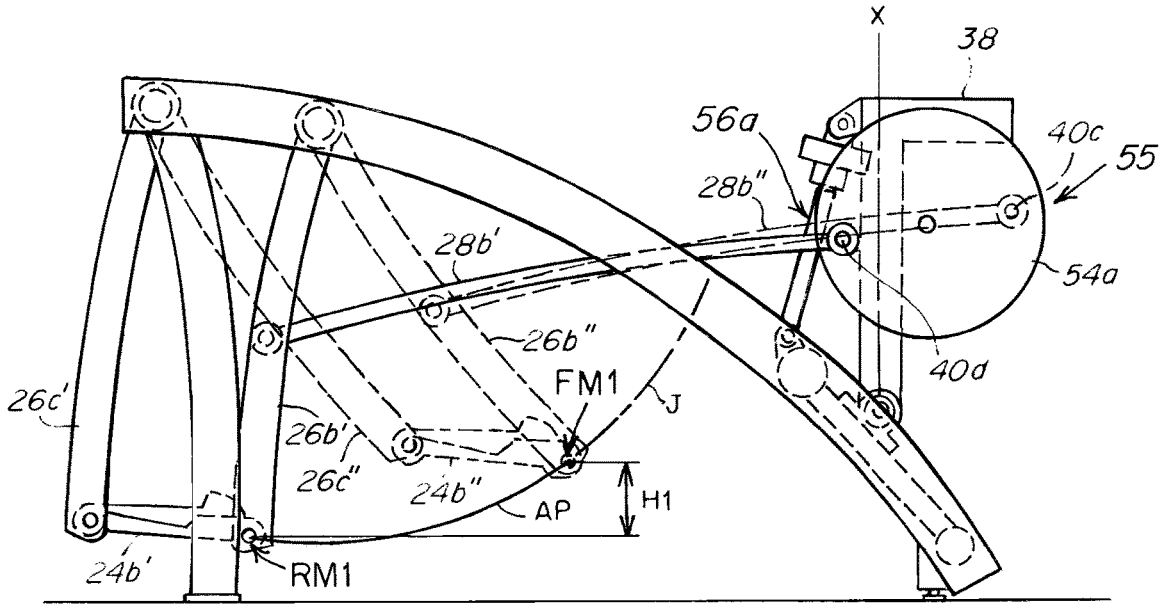
FIG. 10 is a side view of a subassembly of an apparatus according to the invention showing the linkage assemblies adjusted to limit the travel of the foot supports along a first selected arc segment AP of an overall or master segment J the, selected segment AP limiting the travel of the foot supports between a first forwardmost position FM1 and a first rearwardmost position RM1.
Figure 11:
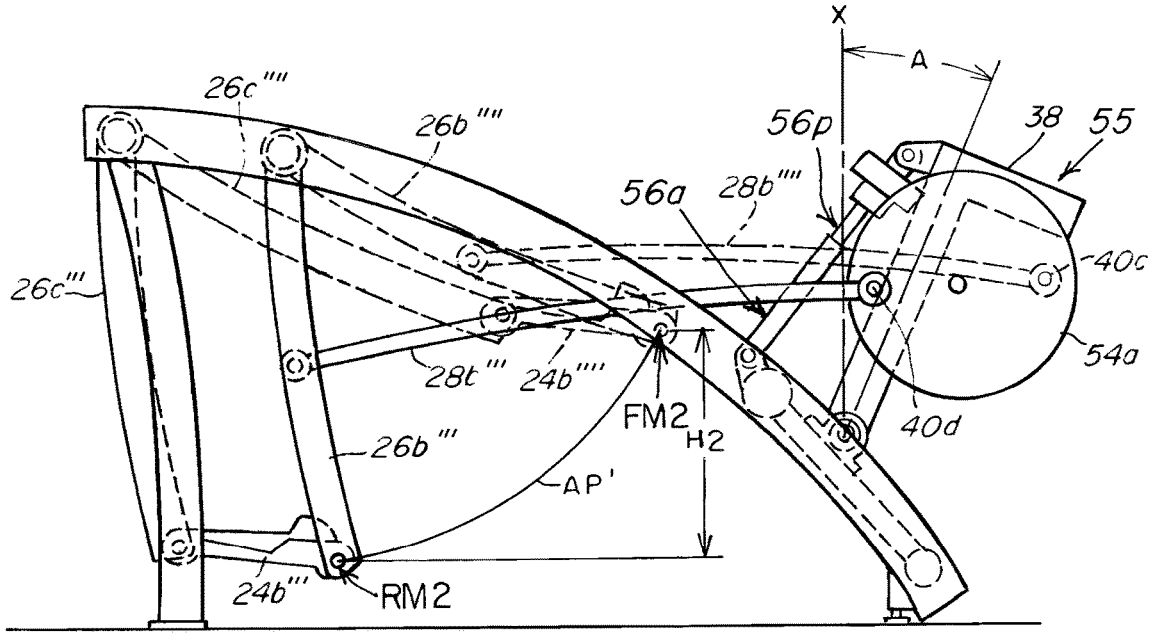
FIG. 11 is a view similar to FIG. 10 showing the linkage assemblies foot adjusted to limit the travel of the foot supports along a second selected arc segment AP' of the overall or master segment J the, selected segment AP' limiting the travel of the foot supports between a second forwardmost position FM2 and a second rearwardmost position RM2.

FIGS. 10 and 11 more clearly illustrate the previously described selectability of the arc segment when the mounting member 38 and its associated control components 30 such as flywheel 54*a*, brake and crank elements is/are pivoted or tilted from one orientation to another. As shown in FIG. 10, the pivotable mounting member 38 is positioned with its longitudinal axis X arranged in about a vertical orientation. In this orientation, the maximum difference in height or incline H1 between the rearwardmost position 24*b*' of the foot pedal 24*b* and forwardmost position 24*b*" of the foot pedal 24*b* is less than the maximum difference in height or incline H2 of FIG. 11 where the axis of the mounting member 38 and its associated components 30 have been tilted or pivoted forwardly by an angle A from the position of FIG. 10. As shown, the arcuate path AP of the pedals 24*b* in FIG. 10, going from position 24*b*' to 24*b*" is less steep or upwardly inclined than the arcuate path AP' of the pedals going from position 24*b*'" to 24*b*"" in FIG. 11. Thus, as shown, the user can select the degree of arc of travel of the pedals by selecting the position of tilt of assembly 30 to which the linkage bars 28*b* are attached.

As also shown in FIGS. 10 and 11 the pedals travel along the same path AP or AP' from front to rear and from rear to front.

Figure 12:
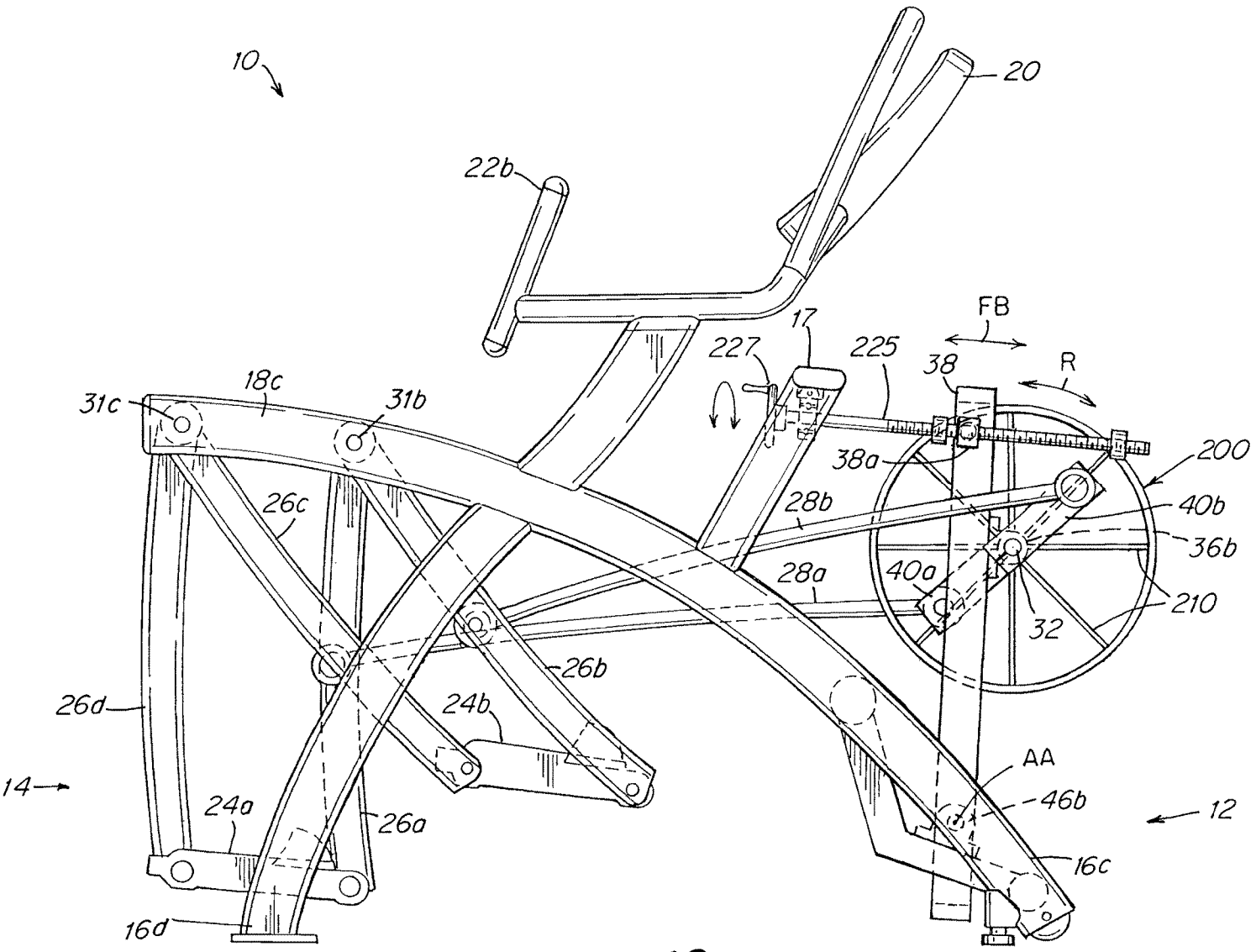
FIG. 12 is a right side view of an apparatus similar to the FIG. 1 apparatus showing the resistance assembly 55 without a housing and having a manually actuatable arc segment selection device such as a screw with a handle.
Figure 12A:
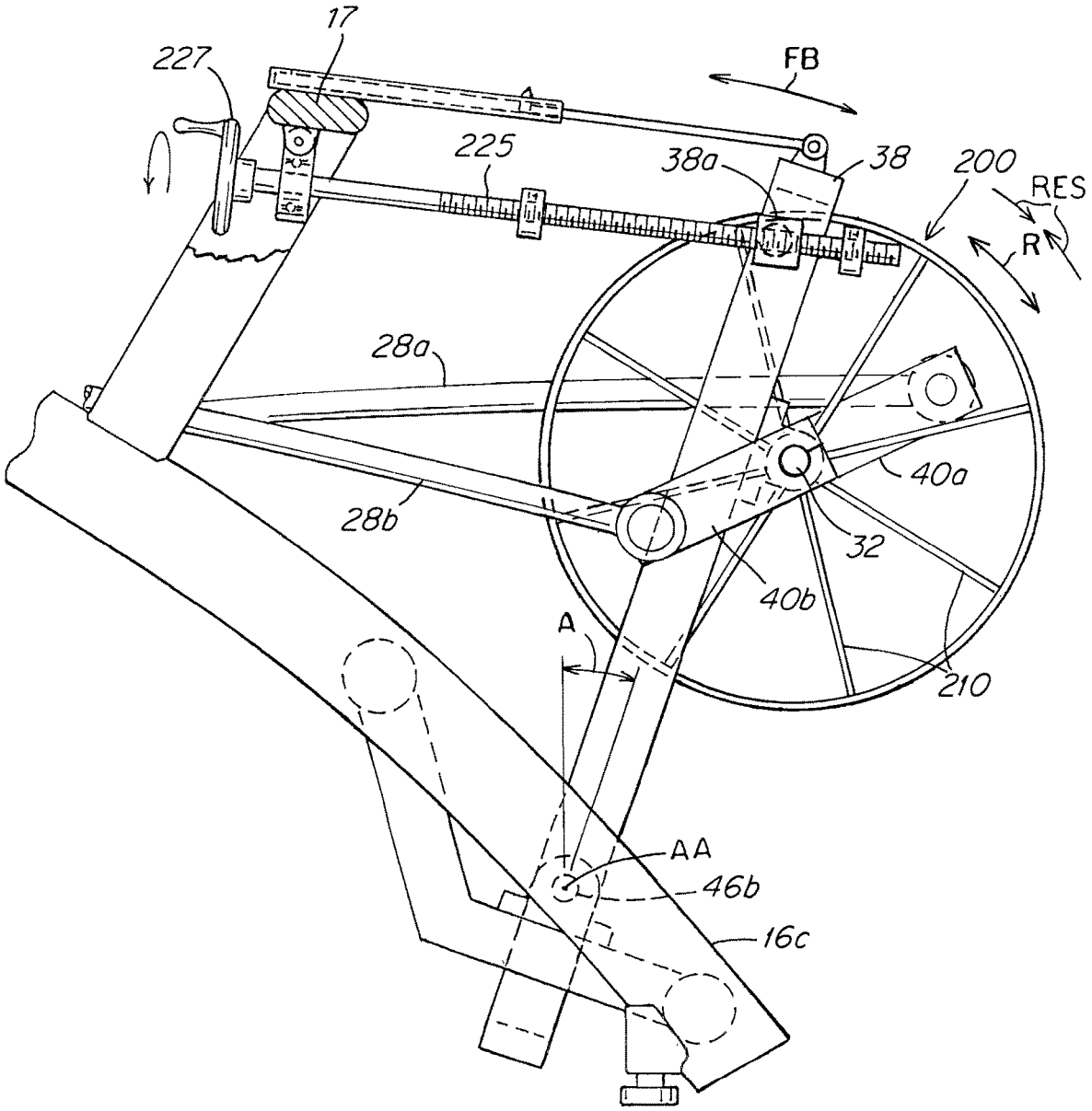
FIG. 12A is an enlarged right side view of a portion of FIG. 12 showing the resistance assembly in a forwardly pivoted position relative to the position of the resistance assembly as shown in FIG. 12.
Figure 12B:
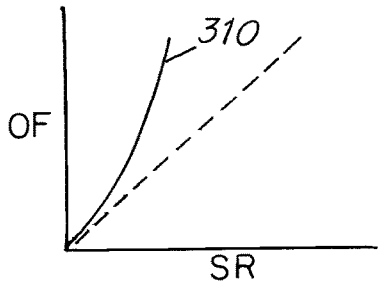
FIG. 12B is a plot showing the non-linearly increasing relationship between the degree of opposing force exerted by a fan wheel against the user's exertion of input force and the rotational speed of the fan.

As shown in FIGS. 12, 12A, the arc segment selection device can comprise a manually, as opposed to motor 56, driven, device such as a screw 225 having a manually engageable and drivable crank or wheel handle 227 connected to a proximal end of the screw 225 that is preferably mounted so as to be readily manually accessible and engageable by a user located in the user disposition region 14 of the apparatus 10. The handle is readily rotatable or turnable by hand by a typical human user so as enable the user to readily effect rotation T of the screw 225 to any desired degree of rotation quickly and immediately upon manual engagement. The screw 225 is screwably engaged at distal position with a screw receiving bracket or nut 38*a*, FIG. 12, that is attached to the mounting bracket or arm 38 such that when the screw 225 is rotated either counterclockwise or clockwise, the bracket or arm 38 will pivot back and forth FB a selectable distance depending on the degree of rotation T of the screw. In the same manner as described below with reference to the motor driven adjustment embodiments the degree of such pivoting back and forth FB of bracket or arm 38 as determined by the degree and direction of rotation T of screw 225 enables the user to selectively change the identity of the particular arc segment AP, AP' through which the foot pedals 24*a*, 24*b* will travel when the pedals are driven between a forwardmost upward FM1, FM2 and rearwardmost RM1, RM2 downward position. Depending on the particular arc segment chosen by the user, the degree of incline of the foot pedals and thus the degree of difficulty of driving the foot pedals 24*a*, 24*b* back and forth will vary as described above with reference to the motor driven arc segment selection device. As shown in FIG. 12 the bracket or arm 38 is disposed in a first generally vertical disposition similar to the disposition shown in FIG. 10. As shown in FIG. 12A, the screw has been turned T such that the bracket or arm 38 is now disposed at an angle A relative to the position of FIG. 12A (similar to the difference in arm and foot pedal positions between FIG. 10 and FIG. 11) and the horizontal components of force required to drive the foot pedals 24*a*, 24*b* through the new arc segment associated with the new pivoted position A of the bracket or arm 38 has changed relative to the position of the arm in FIG. 12 and thus degree of difficulty of the force F needed to perform an exercise cycle has been selectively changed by the user.

It will be appreciated by persons skilled in the art that the present invention is not limited to what has been particularly shown and described herein, and that the drawings are not necessarily to scale. A variety of modifications and variations are possible in light of the above teachings without departing from the scope and spirit of the invention, which is limited only by the following claims.

What is claimed is:

1. An exercise device comprising:

a frame having a generally vertical planar axis that extends longitudinally along a longitudinal axis of the frame from a front of the frame to a back of the frame, first and second foot supports suspended on the frame by respective first and second linkage assemblies that are each arranged on the frame such that each of the first and second foot supports is pivotable through a master arcuate path of travel within a generally vertical travel plane that is disposed at a selectable angle relative to the generally vertical planar axis, wherein the respective master arcuate paths of travel of the first and second foot supports each extend between a respective forwardwardmost upward lateral position and a respective rearwardmost downward lateral position relative to the frame;

at least one of the first and second linkage assemblies being interconnected to an adjustment device that is adjustable by a user to select one of a plurality of discrete segments of the master arcuate path of travel for the respective one of the first and second foot supports;

the first and second linkage assemblies being interconnected to a pair of lateral adjustment devices, respectively, that enable the user to adjust the selectable angle by a selected degree;

wherein each one of the plurality of discrete segments is delimited by a unique forwardmost lateral position and a unique rearwardmost lateral position relative to the frame, each of the unique forwardmost lateral positions and unique rearwardmost lateral positions being contained within the respective master arcuate path of travel;

wherein the master arcuate paths of travel are each circular paths defined around a single point; and the first and second linkage assemblies each have a respective first end and second end, wherein the first ends of the first and second linkage assemblies are pivotally engaged with the frame at the pair of lateral adjustment devices, respectively, and the second end of each linkage assembly is pivotally engaged with the respective one of the first and second foot supports.

2. The exercise device of claim 1, wherein the frame and first and second linkage assemblies are arranged such that respective front edges of longitudinal axes of the first and second foot supports when disposed in the respective unique rearwardmost lateral positions are each spaced a rear lateral distance from the generally vertical planar axis that extends from 10.2 cm to 91.4 cm (four inches to three feet) measured along a line between the respective front edge and the generally vertical planar axis that intersects the generally vertical planar axis at ninety degrees; and the front edges of the longitudinal axes of the first and second foot supports when disposed in the respective unique forwardmost lateral positions are each spaced a forward lateral distance from the generally vertical planar axis that is at least 7.6 cm (three inches) less than the rear lateral distance measured along the line between the respective front edge and the generally vertical planar axis that intersects the generally vertical planar axis at ninety degrees.

3. The exercise device according to claim 2, further comprising a resistance assembly, wherein the resistance assembly comprises a flywheel, pulley, or crank.

4. The exercise device according to claim 2, wherein the adjustment device is manually actuatable by the user to enable the user to manually move the adjustment device to any selectable one of a plurality of different fixed mechanical positions that fix or limit travel of the first and second foot supports via interconnection of the adjustment device to a corresponding one of the plurality of discrete segments, the user selecting one of the plurality of discrete segments by exerting a selected amount or degree of manual force on the adjustment device that corresponds to a selected one of the plurality of different fixed mechanical positions.

5. The exercise device according to claim 1, further comprising a resistance assembly, wherein the resistance assembly comprises a flywheel, pulley, or crank.

6. The exercise device according to claim 5, further including a segment adjustment device interconnected to the resistance assembly in an arrangement that defines said plurality of discrete segments such that each discrete segment has a different degree of incline.

7. The exercise device according to claim 6, wherein the adjustment device is manually actuatable by the user to enable the user to manually move the adjustment device to any selectable one of a plurality of different fixed mechanical positions that fix or limit travel of the first and second foot supports via interconnection of the adjustment device to a corresponding one of the plurality of discrete segments, the user selecting one of the plurality of discrete segments by exerting a selected amount or degree of manual force on the adjustment device that corresponds to a selected one of the plurality of different fixed mechanical positions.

8. The exercise device according to claim 5, wherein the resistance assembly comprises a crank, and wherein the exercise device further comprises a motor interconnected to the crank, the motor being operable to move a location of the crank to controllably select between individual ones of the plurality of discrete segments.

9. The exercise device according to claim 5, wherein the adjustment device is manually actuatable by the user to enable the user to manually move the adjustment device to any selectable one of a plurality of different fixed mechanical positions that fix or limit travel of the first and second foot supports via interconnection of the adjustment device to a corresponding one of the plurality of discrete segments, the user selecting one of the plurality of discrete segments by exerting a selected amount or degree of manual force on the adjustment device that corresponds to a selected one of the plurality of different fixed mechanical positions.

10. The exercise device according to claim 1, wherein the adjustment device is manually actuatable by the user to enable the user to manually move the adjustment device to any selectable one of a plurality of different fixed mechanical positions that fix or limit travel of the first and second foot supports via interconnection of the adjustment device to a corresponding one of the plurality of discrete segments, the user selecting one of the plurality of discrete segments by exerting a selected amount or degree of manual force on the adjustment device that corresponds to a selected one of the plurality of different fixed mechanical positions.

11. The exercise device according to claim 1, further comprising first and second manually graspable input arms each pivotably interconnected to a respective one of the first and second foot supports.

12. The exercise device according to claim 11, wherein the first and second manually graspable input arms are interconnected to the respective ones of the first and second foot supports in an arrangement wherein:

the first manually graspable input arm pivots forwardly relative to the frame together with forward and upward movement of the first foot support relative to the frame, the first manually graspable input arm pivots rearwardly relative to the frame together with backward and downward movement of the first foot support relative to the frame, the second manually graspable input arm pivots forwardly relative to the frame together with forward and upward movement of the second foot support relative to the frame, and the second manually graspable input arm pivots rearwardly relative to the frame together with backward and downward movement of the second foot support relative to the frame.

13. The exercise device according to claim 1, wherein the first and second linkage assemblies each comprise a four bar linkage.

14. The exercise device according to claim 13, wherein the first and second foot supports comprise or are mounted on respective linkages of the respective four bar linkage.

15. The exercise device according to claim 1, wherein the selectable angle is between ten and twenty-five degrees relative to the generally vertical planar axis.

16. The exercise device of claim 1, wherein the selectable angle is between five and forty-five degrees.

* * * * *